US007833686B2

(12) United States Patent
Kadota et al.

(10) Patent No.: US 7,833,686 B2
(45) Date of Patent: Nov. 16, 2010

(54) TONER AND METHOD FOR PRODUCING THE SAME, TONER KIT, AND DEVELOPER, PROCESS CARTRIDGE, IMAGE FORMING METHOD AND IMAGE FORMING APPARATUS

(75) Inventors: Takuya Kadota, Kobe (JP); Minoru Nakamura, Takarazuka (JP); Masayuki Hagi, Minoo (JP); Yoshihiro Mikuriya, Nishinomiya (JP); Katsunori Kurose, Takarazuka (JP); Hideaki Yasunaga, Ibaraki (JP); Hiroaki Kato, Nagaokakyo (JP); Yoshimichi Ishikawa, Itami (JP); Atsushi Yamamoto, Kawanishi (JP); Masahide Inoue, Katsuragi (JP)

(73) Assignee: Ricoh Company, Ltd., Tokyo (JP)

( * ) Notice: Subject to any disclaimer, the term of this patent is extended or adjusted under 35 U.S.C. 154(b) by 934 days.

(21) Appl. No.: 11/616,198

(22) Filed: Dec. 26, 2006

(65) Prior Publication Data

US 2007/0148568 A1 Jun. 28, 2007

(30) Foreign Application Priority Data

Dec. 27, 2005 (JP) ..... 2005-374599
Dec. 27, 2005 (JP) ..... 2005-374616

(51) Int. Cl.
*G03G 9/08* (2006.01)

(52) U.S. Cl. ..... 430/108.4; 430/108.1

(58) Field of Classification Search ..... 430/108.1, 430/108.4

See application file for complete search history.

(56) References Cited

U.S. PATENT DOCUMENTS 5,905,011 A * 5/1999 Kurose et al. ..... 430/108.3
2002/0022189 A1 2/2002 Kawanishi et al.
2006/0204882 A1 9/2006 Nozaki et al.
2006/0210902 A1 9/2006 Nakamura et al.
2006/0275686 A1 12/2006 Kadota et al.
2007/0026335 A1 2/2007 Yamamoto et al.
2007/0148568 A1 6/2007 Kadota et al.
2007/0190442 A1 8/2007 Nakamura et al.
2008/0199234 A1 8/2008 Hagi et al.

FOREIGN PATENT DOCUMENTS

JP 5-72812 3/1993
JP 5-165257 7/1993
JP 7-84409 3/1995
JP 8-30023 2/1996
JP 8-123096 5/1996

(Continued)

OTHER PUBLICATIONS

Translation of JP 2002-287429 published Oct. 2002.*

(Continued)

*Primary Examiner*—Mark F Huff
*Assistant Examiner*—Peter L Vajda
(74) *Attorney, Agent, or Firm*—Oblon, Spivak, McClelland, Maier & Neustadt, L.L.P.

(57) ABSTRACT

A toner kit containing at least a black toner, a yellow toner, a magenta toner and a cyan toner, wherein these toners have at least the binder resin, the colorant and the charge controlling agent having the molecular structure containing K+ as the counterion, when the K+ intensity detected by the fluorescent X ray on the surface of the black toner is Kk, the K+ intensity detected by the fluorescent X ray on the surface of the yellow toner is Ky, the K+ intensity detected by the fluorescent X ray on the surface of the magenta toner is Km and the K+ intensity detected by the fluorescent X ray on the surface of the cyan toner is Kc, the following formulae: Kk<Ky, Kk<Km and Kk<Kc are fulfilled is provided.

19 Claims, 5 Drawing Sheets

FOREIGN PATENT DOCUMENTS

| | | |
|---|---|---|
| JP | 8-160670 | 6/1996 |
| JP | 10-246987 | 9/1998 |
| JP | 10-293425 | 11/1998 |
| JP | 2000-10345 | 1/2000 |
| JP | 2000-338717 | 12/2000 |
| JP | 2001-154412 | 6/2001 |
| JP | 2001-166535 | 6/2001 |
| JP | 2002-196538 | 7/2002 |
| JP | 2002-287429 | * 10/2002 |
| JP | 2003-241416 | 8/2003 |
| JP | 2003-270853 | 9/2003 |
| JP | 3493452 | 11/2003 |
| JP | 2004-085999 | 3/2004 |
| JP | 2004-117551 | 4/2004 |

OTHER PUBLICATIONS

Diamond, Handbook of Imaging Materials, Marcel Dekker Inc., NY, NY, 1991. p. 160-163.*

U.S. Appl. No. 11/378,403, filed Mar. 20, 2006, Minoru Nakamura, et al.

U.S. Appl. No. 11/372,186, filed Mar. 10, 2006, Tsuyoshi Nozaki, et al.

U.S. Appl. No. 11/411,179, filed Apr. 26, 2006, Takuya Kadota, et al.

U.S. Appl. No. 11/496,512, filed Aug. 1, 2006, Yamamoto, et al.

U.S. Appl. No. 11/681,530, filed Mar. 2, 2007, Kadota, et al.

U.S. Appl. No. 11/674,244, filed Feb. 12, 2007, Nakamura, et al.

U.S. Appl. No. 11/851,617, filed Sep. 7, 2007, Murakami, et al.

U.S. Appl. No. 11/854,783, filed Sep. 13, 2007, Nakamura, et al.

U.S. Appl. No. 11/855,739, filed Sep. 14, 2007, Fuwa, et al.

U.S. Appl. No. 11/857,175, filed Sep. 18, 2007, Matsumoto, et al.

U.S. Appl. No. 11/963,279, filed Dec. 21, 2007, Mikuriya, et al.

U.S. Appl. No. 11/965,522, filed Dec. 27, 2007, Fuwa, et al.

U.S. Appl. No. 12/051,248, filed Mar. 19, 2008, Hagi, et al.

U.S. Appl. No. 12/010,369, filed Jan. 24, 2008, Yasunaga, et al.

U.S. Appl. No. 12/027,704, filed Feb. 7, 2008, Fuwa, et al.

U.S. Appl. No. 12/048,865, filed Mar. 14, 2008, Yasunaga, et al.

U.S. Appl. No. 12/017,617, filed Jan. 22, 2008, Hagi, et al.

U.S. Appl. No. 12/342,656, filed Dec. 23, 2008, Fuwa, et al.

U.S. Appl. No. 11/616,198, filed Dec. 26, 2006, Kadota, et al.

U.S. Appl. No. 11/851,048, filed Sep. 6, 2007, Murakami, et al.

U.S. Appl. No. 11/855,759, filed Sep. 14, 2007, Katoh, et al.

U.S. Appl. No. 11/856,248, filed Sep. 17, 2007, Murakami, et al.

* cited by examiner

TONER AND METHOD FOR PRODUCING THE SAME, TONER KIT, AND DEVELOPER, PROCESS CARTRIDGE, IMAGE FORMING METHOD AND IMAGE FORMING APPARATUS

BACKGROUND OF THE INVENTION

1. Field of the Invention

The present invention relates to toner used for copying machines and printers practically applying electrophotographic technology, and a method for production thereof, a toner kit, as well as a developer, a process cartridge, an image forming method and an image forming apparatus.

2. Description of the Related Art

Conventionally, in electrophotography, a latent electrostatic image formed by charging and exposing a surface of a photoconductor (hereinafter sometimes also referred to as an "image bearing member", a "latent electrostatic image bearing member" or an "electrophotographic photoconductor") is developed with toner to form a toner image, the toner image is transferred onto a recording media such as transfer paper, and this is fixed by a heating roll to form an image.

In a dry developing method employed in electrophotographs and electrostatic recording, there are a method of using a two-component developer composed of the toner and a carrier and a method of using one-component developer containing no carrier. In the method of using the two-component developer, good images are obtained relatively stably, but there is a shortcoming in that an apparatus constitution becomes large. Meanwhile, in the method of using the one-component developer, typically the toner (developer) is fed by at least one toner feeding member, and an electrostatic image formed on an image bearing member by the toner is made into a visible image. At that time, a thickness of a toner layer fed on the surface of the toner feeding member must be thinned as possible. In particular, since this toner is necessary to be charged by a development apparatus when the toner having high electric resistance is used, the thickness of the toner layer must be formed extremely thinly. This is because if the toner layer is thick, only a vicinity of the surface of the toner layer is charged and the entire toner layer is hardly charged uniformly.

From such a request, as a unit (toner layer thickness regulating unit) which regulates the thickness of the toner layer on the toner feeding member, various methods are proposed. As a representative example, a regulatory blade is used, the regulatory blade is opposed to the toner feeding member, and the toner fed on the toner feeding member is pushed down with the regulatory blade to control the thickness of the toner layer. A type in which a roller in place of the regulatory blade is abutted to the surface of the toner feeding member to obtain the same effect has been also proposed.

In a developing, in the toner layer formed on the surface of a developing sleeve by a developer layer thickness regulating member, the toner present in the vicinity of the surface of the developing sleeve has extremely high charge, is attracted by a mirroring force to the surface of the developing sleeve and becomes an immobilized state on the surface of the developing sleeve. Thus, the toner does not migrate from the developing sleeve to a latent image on an image bearing member, and a charge-up phenomenon easily occurs. In particular, the charge-up phenomenon easily occurs under low humidity.

When such a charge-up phenomenon occurs, the toner in an upper layer of the toner layer formed on the developing sleeve is hardly charged, and thus, an amount of the charged toner is reduced. As a result, scumming in non-image sections, toner leaking and toner scattering easily occur.

To eliminate such phenomena, it is necessary to control the amount of the charged toner in the toner layer formed on the developing sleeve as uniformly as possible.

When a developing roller is a metal and the regulatory blade is a resin, if the toner having a different charge property is used, developing members, particularly the regulatory blade and a development setup must be individually changed, leading to being complicated and simultaneously cost up.

Meanwhile, when the developing roller is the resin and the regulatory blade is the metal, the developing members, particularly a developing roller member and the development setup must be individually changed, leading to being complicated and simultaneously cost up.

Here, for the black toner, since carbon black usually used is conductive, a charge keeping capacity of the black toner itself is lower than that of the color toner. For example, in the black toner described in Japanese Patent Application Laid-Open (JP-A) No. 10-246987, a benzyl boron-based charge controlling agent is used, and since originally the charge-up is hardly made, defect of charge hardly occurs.

In JP-A No. 5-165257, the benzyl boron-based charge controlling agent is used for the color toner. Since an existing state of the charge controlling agent is not controlled, if the charge controlling agent is abundantly present in the vicinity of the surface, an internal resistance is kept high and the charge-up is not inhibited. If the amount of charge controlling agent in the vicinity of the surface is small, the surface resistance becomes also high, and the charge-up occurs or the charge is reduced because the charge controlling agent is not functioned.

A salicylic acid-based charge controlling agents described in JP-A No. 10-246987 are colorless or almost colorless, and thus, are preferably used for the color toner. But, since these have the effect to generate the charge but do not leak the charge, the charge-up phenomenon easily occurs. When the charge-up phenomenon of the toner occurs, a distribution of the charged toner on the developing roller becomes broad, and the scumming and density reduction are caused.

In JP-A No. 2004-117551, benzyl boron-based charge controlling agents are used in the black toner and the color toner. However, in this proposal, since the existing state of the charge controlling agent is not controlled, difference occurs in charge property between the black toner and the color toner. Under a high temperature and high humidity environment and a low temperature and low humidity environment, density transition is different. Thus, development control for full color images becomes complicated.

SUMMARY OF THE INVENTION

First, the present invention aims at providing toner where occurrence of a charge-up phenomenon can be prevented by controlling an amount of a charge controlling agent present inside the toner and on a surface of the toner, charge reduction is inhibited, and good images without defects such as scumming and image density reduction due to the charge can be obtained, and a method for production thereof, as well as a developer, a process cartridge, an image forming method and an image forming apparatus using the toner.

Second, the present invention aims at providing a toner kit which can eliminate color difference between under a high temperature and high humidity environment and a low temperature and low humidity environment, eliminate density unevenness on a full color image, control the charge-up and form a good image having no defect such as scumming and density reduction due to the charge by controlling an amount of a charge controlling agent present on the surface of black toner and color toner, as well as a developer, a process cartridge, an image forming method and an image forming apparatus using the toner kit.

The toner of the present invention contains at least a binder resin, a colorant, and a charge controlling agent having a molecular structure containing K+ as a counterion, and has a ratio (A/B) of 0.1 to 0.3 of K+ intensity "A" detected by fluorescent X ray on the toner surface to K+ intensity "B" in the entire toner. In the toner of the present invention, by controlling the amount of the charge controlling agent present inside the toner and on the surface of the toner, it is possible to inhibit the charge-up and the charge reduction and form the good image having no defect such as scumming and image density reduction due to the charge.

The method for producing the toner of the present invention includes a step of mixing a toner material containing at least the binder resin, the colorant and the charge controlling agent having the molecular structure containing K+ as the counterion so that a ratio (A/B) of K+ intensity "A" detected by fluorescent X ray on the toner surface to K+ intensity "B" detected by fluorescent X ray in the entire toner is 0.1 to 0.3, and a step of kneading and pulverizing a resulting kneaded product.

The toner kit of the present invention contains at least a black toner, a yellow toner, a magenta toner and a cyan toner, all of the black toner, the yellow toner, the magenta toner and the cyan toner contain at least a binder resin, a colorant and a charge controlling agent, the colorant of the black toner contains at least either carbon black or magnetic powder, and the charge controlling agent has the molecular structure containing K+ as the counterion. When the K+ intensity detected by the fluorescent X ray on the surface of the black toner is Kk, the K+ intensity detected by the fluorescent X ray on the surface of the yellow toner is Ky, the K+ intensity detected by the fluorescent X ray on the surface of the magenta toner is Km and the K+ intensity detected by the fluorescent X ray on the surface of the cyan toner is Kc, the following formulae: $Kk<Ky$, $Kk<Km$ and $Kk<Kc$ are fulfilled. Thus, in the case of using the charge controlling agent for the full color toner, by controlling the amount of the charge controlling agent present on the surface of the black toner and the color toners, it is possible to eliminate the color difference between the environments, eliminate the density unevenness on the full color image and easily control the density.

A image forming apparatus of the present invention contains at least a latent electrostatic image bearing member, a latent electrostatic image forming unit which forms a latent electrostatic image on the latent electrostatic image bearing member, a developing unit which develops the latent electrostatic image using each toner in the toner kit to form a visible image, a transferring unit which transfers the visible image onto a recording media, and a fixing unit which fixes a transfer image transferred on the recording media, and uses each toner in the toner kit of the present invention as the toner. Thus, the color difference between under the high temperature and high humidity environment and the low temperature and low humidity environment is eliminated, and no density unevenness in the full color image occurs, the charge-up is inhibited and the good image having no defect such as scumming and density reduction due to the charge is obtained.

A image forming method of the present invention contains at least a latent electrostatic image forming which forms a latent electrostatic image on a latent electrostatic image bearing member, a developing which develops the latent electrostatic image using each toner in the toner kit to form a visible image, a transferring which transfers the visible image onto a recording media, and a fixing which fixes a transfer image transferred on the recording media, and uses each toner in the toner kit of the present invention as the toner. Thus, it is possible to eliminate the color difference between under the high temperature and high humidity environment and the low temperature and low humidity environment, eliminate the density unevenness in the full color image, inhibit the charge-up and form the good image having no defect such as scumming and density reduction due to the charge.

Figure 1:
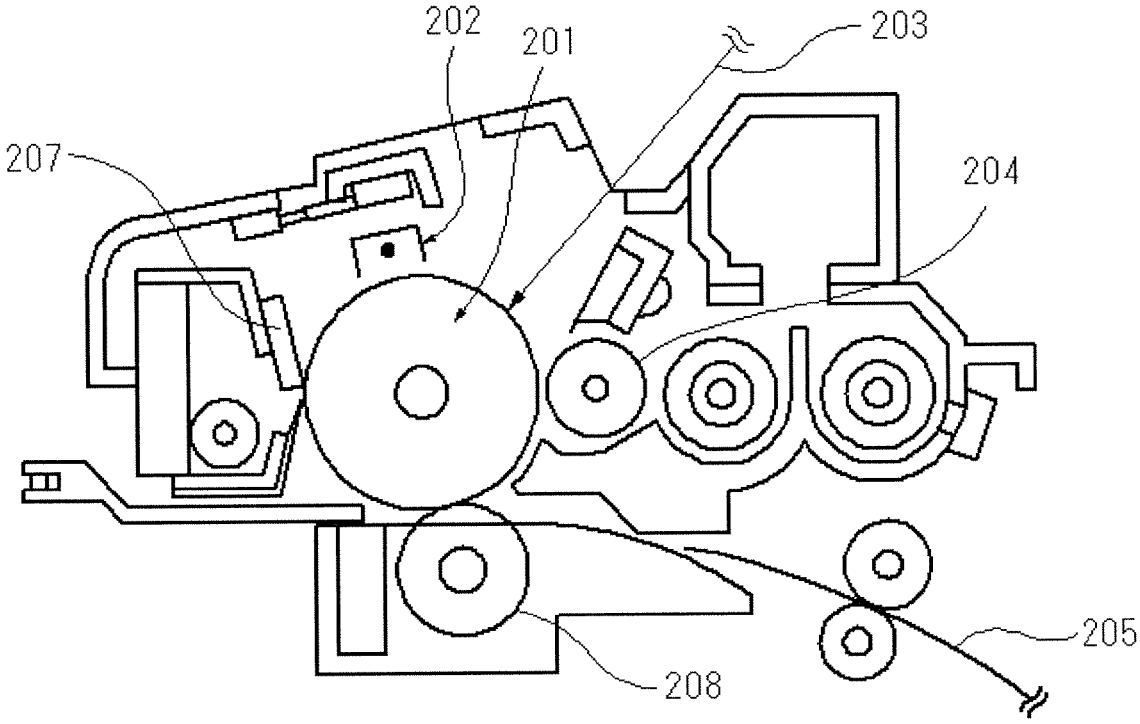
FIG. 1 is a schematic view showing one example of a process cartridge of the present invention.

DESCRIPTION OF THE PREFERRED EMBODIMENTS (Toner and Method for Producing Toner)

The toner of the present invention contains at least a binder resin, a colorant and a charge controlling agent having a molecular structure containing K+ as a counterion, and further contains other ingredients as needed.

The method for producing the toner of the present invention includes a step of mixing a toner material containing at least the binder resin, the colorant and the charge controlling agent having the molecular structure containing K+ as the counterion so that a ratio (A/B) of K+ intensity "A" detected by fluorescent X ray on the toner surface to K+ intensity "B" detected by fluorescent X ray in the entire toner is 0.1 to 0.3, and a step of kneading and pulverizing a resulting kneaded product, and further comprises other step as needed.

The toner of the present invention will be shown in detail with reference to the description of the method for producing the toner of the present invention.

In the present invention, the ratio (A/B) of the K+ intensity "A" detected by the fluorescent X ray on the toner surface to the K+ intensity "B" in the entire toner is 0.1 to 0.3. When the ratio (A/B) is less than 0.1, a charge-up phenomenon of charge occurs, the charge of the toner supplied to a developing roller becomes uneven and scumming is sometimes caused. When it exceeds 0.3, the charge of the toner itself is reduced, and this sometimes causes the scumming and the density reduction.

It is preferable to comprise a black toner making step of making the black toner by mixing the toner material containing at least the binder resin, the colorant of either carbon black or magnetic powder and the charge controlling agent having the molecular structure containing K+ as the counterion, kneading and pulverizing a resulting kneaded one; and a color toner making step of making the color toner by mixing the toner material containing at least the binder resin, the colorant of at least either a yellow colorant, a magenta colorant or a cyan colorant and the charge controlling agent having the molecular structure containing K+ as the counterion, kneading and pulverizing a resulting kneaded one; and to fulfill the following formula Kk<Kc when the K+ intensity detected by the fluorescent X ray on the black toner surface is Kk and the K+ intensity detected by the fluorescent X ray on the color toner surface is Kc. In this case, the ratio of Kk to Kc (Kk/Kc) is preferably 0.3 to 0.6. When the ratio is less than 0.3, the charge of the black toner becomes excessively high compared with other three colors, which sometimes causes the density reduction. When it exceeds 0.6, the charge of the black toner becomes lower compared with other three colors, which sometimes cause the scumming and the image unevenness.

Here, the K+ intensity on the toner surface and in the entire toner can be measured by the fluorescent X ray. In this case, the toner is dissolved in dimethylformamide (DMF), and thus, the amount of the charge controlling agent in the entire toner can be detected. The toner is insoluble in ethanol, but the charge controlling agent present on the toner surface is dissolved in ethanol, and thus the amount of the charge controlling agent on the toner surface can be detected. From these measured values, the K+ intensity on the toner surface and in the entire toner can be determined.

Specifically, the potassium intensity on the toner surface was determined as follows. The toner (0.5 g) was dissolved in 20 mL of ethanol. This solution (5 mL) was placed in a polyethylene container with an external diameter of 32 mm, an internal diameter of 25 mm and a height of 23 mm. Using this, an X ray intensity of potassium was measured under a condition of 50 kV, 60 mA and 40 seconds in vacuum using a bottom irradiation type fluorescent X ray measurement apparatus (Rigaku Corporation). A net intensity obtained by subtracting a background value was rendered the potassium intensity "A" present on the toner surface.

The potassium intensity in the entire toner was determined as follows. The toner (0.5 g) was dissolved in 20 mL of dimethylformamide (DMF). This solution (5 mL) was placed in a polyethylene container with an external diameter of 32 mm, an internal diameter of 25 mm and a height of 23 mm. Using this, an X ray intensity of potassium was measured under a condition of 50 kV, 60 mA and 40 seconds in vacuum using the bottom irradiation type fluorescent X ray measurement apparatus (Rigaku Corporation). A net intensity obtained by subtracting a background value was rendered the potassium intensity "B" present in the entire toner.

Here, the potassium intensity in the entire toner means a potassium amount contained on the toner surface and inside the toner.

(Toner Kit)

The toner kit of the present invention has at least a black toner, a yellow toner, a magenta toner and a cyan toner, and all of the black toner, the yellow toner, the magenta toner and the cyan toner contain at least the binder resin, the colorant and the charge controlling agent, and further contain other ingredients as needed.

Either carbon black or magnetic powder is used as the colorant of the black toner in the above toner kit.

As each toner in the toner kit, it is preferable that to contain the binder resin, the colorant, and the charge controlling agent, wherein the charge controlling agent comprises the molecular structure containing K+ as the counterion, and the ratio (A/B) of the K+ intensity "A" detected by fluorescent X ray on the surface of the toner to the K+ intensity "B" detected by fluorescent X ray in the entire toner is 0.1 to 0.3.

Here, in the above toner kit, when the K+ intensity detected by the fluorescent X ray on the surface of the black toner is Kk, the K+ intensity detected by the fluorescent X ray on the surface of the yellow toner is Ky, the K+ intensity detected by the fluorescent X ray on the surface of the magenta toner is Km and the K+ intensity detected by the fluorescent X ray on the surface of the cyan toner is Kc, the following formulae: Kk<Ky, Kk<Km and Kk<Kc are fulfilled. By fulfilling such relations, it is possible to make the charge property of the black toner which easily decreases in charged amount because electric resistance is lower compared with the yellow, magenta and cyan toners equivalent to the charge properties of the yellow, magenta and cyan toners, and to solve the defect due to charge defect.

In this case, it is preferable that the ratio of Kk to Ky (Kk/Ky), the ratio of Kk to Km (Kk/Km) and the ratio of Kk to Kc (Kk/Kc) are 0.3 to 0.6. When the ratio is less than 0.3, the charge of the black toner becomes excessively high compared with other three colors, which sometimes causes the density reduction. When it exceeds 0.6, the charge of the black toner becomes lower compared with other three colors, which sometimes cause the scumming and the image unevenness.

It is also preferable that the K+ intensity (Kk) detected by the fluorescent X ray on the surface of the black toner is 0.1 to 1.

Here, the K+ intensity on the toner surface can be detected by the fluorescent X ray. Specifically, 0.5 g of the toner was dissolved in 20 mL of ethanol. This solution (5 mL) was placed in the polyethylene container with an external diameter of 32 mm, an internal diameter of 25 mm and a height of 23 mm. Using this, an X ray intensity of potassium was measured under the condition of 50 kV, 60 mA and 40 seconds in vacuum using the bottom irradiation type fluorescent X ray measurement apparatus (Rigaku Corporation). A net intensity obtained by subtracting the background value was rendered the potassium intensity present on the toner surface.

In the toner kit of the present invention, when volume resistance of the black toner is Rk, volume resistance of the yellow toner is Ry, volume resistance of the magenta toner is Rm, and volume resistance of the cyan toner is Rc, it is preferable to fulfill the following formulae: Rk<Ry, Rk<Rm and Rk<Rc.

The volume resistance Rk of the black toner is preferably $0.9\times10^9$ to $5\times10^9\Omega$.

Here, the volume resistance of the above toner can be measured, for example, using an impedance analyzer supplied from Solartron.

<Charge Controlling Agent>

The charge controlling agent used for the toner and the toner kit is not particularly limited as long as it has the molecular structure containing K+ as the counterion, and can be optionally selected depending on the purpose. For example, a benzyl boron compound represented by the following structural formula is particularly preferable because it has K+ as the counterion and the existing state of the charge controlling agent on the toner surface is easily determined by measuring a concentration of this K+ ion.

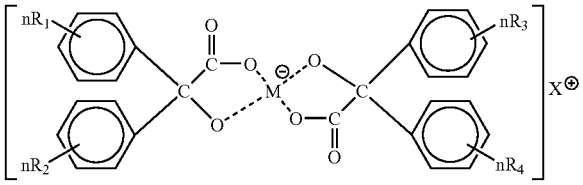

In the above structural formula, M is B (boron), X is K (potassium), $R_1$, $R_2$, $R_3$ or $R_4$ represent each hydrogen atoms, alkyl groups having 1 to 4 carbon atoms, alkoxy groups having 1 to 4 carbon atoms or halogen atoms, when multiple $R_1$, $R_2$, $R_3$ or $R_4$ are present, they may be the same or different, and n is an integer of 1 to 5.

As the benzyl boron compound represented by the above structural formula, the benzyl boron compound represented by the following formula is preferable.

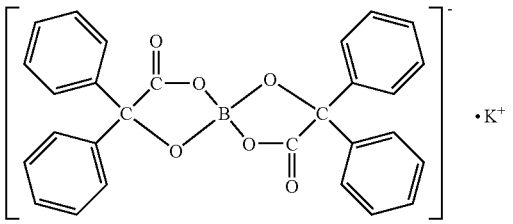

The benzyl boron compound as the charge controlling agent is excellent in rising property of the charge and is suitable for not only the black toner but also the color toners because it is white. But, when the amount of the charge controlling agent present on the toner surface is not optimized, if a durability test or a high temperature and high humidity environment test is performed, the defects such as decrease and increase of charged amounts occur.

In the present invention, in addition to the benzyl boron compound, the other charge controlling agents conventionally used for the full color toners may be combined. The other charge controlling agents include, for example, nigrosine dyes, triphenylmethane dyes, chromium-containing metal complex dyes, molybdic acid chelate pigments, rhodamine-based dyes, alkoxy-based amine, quaternary ammonium salts (including fluorine modified quaternary ammonium salts), alkylamide, a single body or compounds of phosphorus, a single body or compounds of tungsten, fluorine-based active agents, salicylate metal salts and metal salts of salicylic acid derivatives.

Specifically, Bontron 03 of the nigrosine dye, Bontron P-51 of the quaternary ammonium salt, Bontron S-34 of the metal-containing azo dye, E-82 of oxynaphthoic acid-based metal complex, E-81 and E-84 of salicylic acid-based metal complexes, E-89 of phenol-based condensate (supplied from Orient Chemical Industries Ltd.); TP-302 and TP-415 of a quaternary ammonium salt molybdenum complexes (supplied from Hodogaya Chemical Co., Ltd.); Copy Charge PSY VP2038 of the quaternary ammonium salts, Copy Blue PR of the triphenylmethane derivative, Copy Charge NEG VP2036 and Copy Charge NX VP434 of the quaternary ammonium salts (supplied from Hoechst); LRA-901, copper phthalocyanine, perylene, quinacridone, azo-based pigments, and polymer-based compounds having functional groups such as sulfonic acid group, carboxyl group and quaternary ammonium salt are included. Among them, in particular, substances which controls the toner to negative polarity are preferably used.

The amount of the charge controlling agent to be added is determined depending on a type of the binder resin, the presence or absence of additives used as needed and the method for producing the toner including a dispersion method, and is not primarily limited, but is preferably 0.5 to 3 parts by mass and more preferably 0.5 to 2.5 parts by mass relative to 100 parts by mass of the binder resin. When the amount is less than 0.5 parts by mass, the desired charge rising property is not obtained. When it is more than 3 parts by mass, the charge is largely reduced and the effects of the present invention are hardly obtained.

Subsequently, the method for producing a toner base in each toner which composes the toner kit of the present invention is not particularly limited, and can be optionally selected depending on the purpose. For example, (1) the toner base (pulverization method toner) obtained by melting, mixing and uniformly dispersing the colorant, the charge controlling agent, a releasing agent and the like in a thermoplastic resin which is the binder resin ingredient to make a composition, subsequently pulverizing the composition and classifying, (2) a toner base obtained by dissolving or suspending the colorant, the charge controlling agent, the releasing agent and the like in a polymerizable monomer which is the binder resin raw material, adding a polymerization initiator, then dispersing the mixture in an a water-based dispersion vehicle containing a dispersion stabilizer, initiating suspension polymerization by raising up to a given temperature, and performing filtration, washing and drying after completion of the polymerization, (3) a toner base obtained by making a primary particle of the binder resin containing a polar group obtained by emulsification polymerization into a secondary particle by aggregating by adding the colorant and the charge controlling agent, further filtrating and drying the particles associated by stirring at higher temperature than a glass transition temperature of the binder resin, and (4) a transfer phase emulsification method toner base obtained by making a hydrophilic group-containing resin the binder resin, adding the colorant thereto and dissolving the mixture in an organic solvent, subsequently neutralizing the resin to transfer a phase, and then obtaining a colored particle by drying are included. Any of these methods can be used.

Hereinafter, the description is performed using the pulverization method toner as the method for producing the toner base in each toner which composes the toner kit of the present invention, but is not limited thereto. A toner base particle in the toner of the present invention is produced as follows.

The pulverization method toner is the toner obtained by the method for obtaining the toner base of the toner by melting and kneading the toner material containing at least the binder resin, the charge controlling agent and the colorant, pulverizing and classifying. In the case of the pulverization method, for the purpose of increasing an average circularity, the shape may be controlled by giving mechanical impact to the base particles in the resulting toner. In this case, the mechanical impact can be imparted to the base particles of the toner using an apparatus such as hybridizer and mechanofusion.

First, the toner material is mixed. As a mixing machine, the common mixing machine for powder is used, but it is preferable to regulate the inside temperature by comprising a jacket. A rotation frequency, a rotation speed, a time and a temperature of the mixing machine may be changed. Alternatively, first a strong load may be applied, and then a relatively weak load may be given, vice versa. Usable mixing equipments include, for example, a V type mixing machine, a rocking mixer, Loedige mixer, Nauta mixer and Henschel mixer. The mixture is placed in a melting kneading machine and melted and kneaded. As the melting kneading machine, a monoaxial or biaxial continuous kneader, and a batch mode kneader by roll mill can be used. For example, the KTK type biaxial extruder supplied from Kobe Steel, Ltd., the TEM type extruder supplied from Toshiba Machine Co., Ltd., the biaxial extruder supplied form KCK, the PCM type biaxial extruder supplied from Ikegai Tekkosho, and the kneader supplied from Bus are suitably used. It is preferable that this melting and kneading is performed under the proper condition where a molecular chain of the binder resin is not cut.

In the pulverization, a kneaded one obtained in the above kneading is pulverized. It is preferable to roughly pulverize first and then finely pulverize. At that time, the method of pulverizing by conflicting with a confliction plate in jet stream, the method of pulverizing by conflicting particles one another in the jet stream or the method of pulverizing in a narrow gap between a rotor and a stator are preferably used.

In the classification, a pulverized one obtained in the above pulverization is classified to adjust the particles to the given particle diameters. The classification can be performed by removing a fine particle portion using a cyclone separator, a decanter or a centrifuge.

After the completion of the pulverization and the classification, the pulverized one is classified in air flow by centrifugal force to produce the toner having the given particle diameter.

In order to enhance a fluidity, a storage stability, a developing property and a transfer property of the toner, inorganic particles such as hydrophobic silica fine powder may be added to and mixed with the toner base particles produced as the above. The common mixing machine for powder is used for mixing the additive, but it is preferable to regulate the inside temperature by comprising the jacket. To change a loading history given to the additive, the additive may be during the process or progressively. In this case, the rotation frequency, the rotation speed, the time and the temperature of the mixing machine may be changed. Alternatively, first the strong load may be applied, and then the relatively weak load may be given, vice versa. Usable mixing equipments include, for example, a V type mixing machine, a rocking mixer, Loedige mixer, Nauta mixer and Henschel mixer. Then, the particles are passed through a sieve with 250 mesh or more to remove rough particles and aggregated particles, and then the toner is obtained.

Here, the toner material contains at least the binder resin, the colorant and the charge controlling agent, and further contains wax and the other ingredients as needed.

—Binder Resin—

The binder resin is not particularly limited, can be optionally selected depending on the purpose, and includes the binder resins publicly known in the field of the full color toner, e.g., polyester-based resins, (meth)acrylic resins, styrene-(meth)acrylic copolymer resins, epoxy-based resins and COC (cyclic olefin resins) (e.g., TOPAS-COC supplied from Ticona). In terms of stress resistance in a developing device, it is preferable to use the polyester-based resin. These may be used in combination of two or more as needed.

As the polyester-based resin, the polyester resin obtained by polycondensating a polyvalent alcohol component and a polyvalent carboxylic acid component can be used.

Among the polyvalent alcohol components, bivalent alcohol components include bisphenol A alkylene oxide adducts such as polyoxypropylene (2,2)-2,2-bis(4-hydroxyphenyl) propane, polyoxypropylene (3,3)-2,2-bis(4-hydroxyphenyl) propane, polyoxypropylene (6)-2,2-bis(4-hydroxyphenyl) propane, and polyoxyethylene (2,0)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polytetramethylene glycol, bisphenol A, and hydrogenated bisphenol A.

Among the polyvalent alcohol components, trivalent alcohol components include, for example, sorbitol, 1,2,3,6-hexanetetrol, 1,4-sorbitan, pentaerythritol, di pentaerythritol, tri pentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

Among the polyvalent carboxylic acid components, bivalent carboxylic acid components include, for example, maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenyl succinic acid, isooctenyl succinic acid, n-octyl succinic acid, isooctyl succinic acid, or acid anhydrates or lower alkyl esters thereof.

Among the polyvalent carboxylic acid components, trivalent carboxylic acid components include, for example, 1,2,4-benzene tricarboxylic acid (trimellitic acid), 1,2,5-benzene tricarboxylic acid, 2,5,7-naphthalene tricarboxylic acid, 1,2,4-butane tricarboxylic acid, 1,2,5-hexane tricarboxylic acid, 1,2-dicarboxyl-2-methyl-2-methylenecarboxypropane, 1,2,4-cyclohexane tricarboxylic acid, tetra(methylenecarboxyl) methane, 1,2,7,8-octane tetracarboxylic acid, pyromellitic acid, Empol tetramer acid or acid anhydrates or lower alkyl esters thereof.

As the polyester-based resin, the resin (hereinafter sometimes referred to as a "vinyl-based polyester resin" simply) obtained by using a mixture composed of a raw material monomer of the polyester resin, a raw material monomer of the vinyl-based resin and a monomer which reacts with the raw material monomers of both resins and performing the polycondensation reaction to obtain the polyester resin and a radical polymerization reaction to obtain the vinyl-based resin in the same container in parallel can be suitably used. The monomer which reacts with the raw material monomers of both resin is, in other words, the monomer capable of being used for both the polycondensation reaction and the radical polymerization reaction. That is, the monomer is the monomer having the carboxy group capable of performing the polycondensation reaction and the vinyl group capable of performing the radical polymerization reaction, and includes, for example, fumaric acid, maleic acid, acrylic acid and methacrylic acid.

The raw material monomer of the polyester resin includes the polyvalent alcohol components and the polyvalent carboxylic acid components described above. The raw material monomer of the vinyl-based resin includes, for example, styrene derivative such as styrene, o-methylstyrene, m-methylstyrene, p-methylstyrene, α-methylstyrene, p-ethylstyrene, 2,4-dimethylstyrene, p-tert-butylstyrene and p-chlorostyrene; ethylene-based unsaturated monoolefins such as ethylene, propylene, butylene and isobutylene; methacrylate alkyl esters such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate and dodecyl methacrylate; acrylate alkyl esters such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, is hexyl acrylate, octyl acrylate, nonyl acrylate, decyl acrylate, undecyl acrylate and dodecyl acrylate; unsaturated carboxylic acids such as acrylic acid, methacrylic acid, itaconic acid and maleic acid; acrylonitrile, maleate ester, itaconate ester, vinyl chloride, vinyl acetate, vinyl benzoate, vinyl methyl ethyl ketone, vinyl hexyl ketone, vinyl methyl ether, vinyl ethyl ether and vinyl isobutyl ether.

A polymerization initiator when the raw material monomer of the vinyl-based resin is polymerized includes azo-based or diazo-based polymerization initiators such as 2,2'-azobis(2,4-dimethylvaleronitrile), 2,2'-azobisbutironitrile, 1,1'-azobis(cyclohexane-1-carbonitrile) and 2,2'-azobis-4-methoxy-2,4-dimethylvaleronitrile; and peroxide-based polymerization initiators such as benzoyl peroxide, dicumyl peroxide, methyl ethyl ketone peroxide, isopropylperoxy carbonate and lauroyl peroxide.

As the binder resin, various polyester-based resins as the above are preferably used. Among them, in terms of further enhancing a separation property and offset resistance as the toner for oilless fixation, it is more preferable to use a first binder resin and a second binder resin shown below.

As the first binder resin, the polyester resin obtained by polycondensating the polyvalent alcohol component and the polyvalent carboxylic acid component described above is used, in particular, the polyester resin obtained by using bisphenol A alkylene oxide adduct as the polyvalent alcohol component and using terephthalic acid and fumaric acid as the polyvalent carboxylic acid components is suitably used.

As the second binder resin, the vinyl-based polyester resin, in particular the vinyl-based polyester resin obtained by using bisphenol A alkylene oxide adduct, terephthalic acid, trimellitic acid and succinic acid as the raw material monomers of the polyester resin, using styrene and butyl acrylate as the raw material monomers of the vinyl-based resin and using fumaric acid as the monomer reactive with both is suitably used.

It is preferably to internally add hydrocarbon-based wax upon synthesis of the first binder resin. To previously internally add hydrocarbon-based wax to the first binder resin, the first binder resin could be synthesized with adding hydrocarbon-based wax in the monomers for synthesizing the first binder resin when the first binder resin is synthesized. For example, the polycondensation could be performed in the state where hydrocarbon-based wax has been added to acid monomer and alcohol monomer which compose the polyester-based resin as the first binder resin. When the first binder resin is the vinyl-based polyester resin, the polycondensation and the radical polymerization could be performed by dropping the raw material monomers of the vinyl-based resin with stirring and heating the monomers in the state where hydrocarbon-based wax has been added to the raw material monomers of the polyester resin.

—Wax—

Since generally the wax having a lower polarity is more excellent in releasing property from the fixing member roller, the hydrocarbon-based wax having the low polarity is suitably used.

The hydrocarbon-based wax is the wax composed of only carbon atoms and hydrogen atoms, and the wax not containing ester, alcohol and amide groups. The hydrocarbon-based wax includes, for example, polyolefin waxes such as polyethylene, polypropylene and copolymers of propylene with ethylene; petroleum waxes such as paraffin wax and microcrystalline wax; and synthetic waxes such as Fisher Tropsch wax. Among them, polyethylene wax, paraffin wax and Fisher Tropsch wax are preferable, and polyethylene wax and paraffin wax are particularly preferable.

The melting point of the wax is represented by an endothermic peak of the wax upon temperature rising measured by a differential scanning calorimeter (DSC), and is preferably 70° C. to 90° C. When the melting point exceeds 90° C., melt of the wax in a fixing process becomes insufficient and the separation property from the fixing member is not assured sometimes. When it is lower than 70° C., the toner particles are fused one another under the high temperature and high humidity environment, which is problematic in storage stability. To allow for the fixation separation property at low temperature, the melting point of the wax is more preferably 70° C. to 85° C. and still more preferably 70° C. to 80° C.

A half value width of the endothermic peak of the wax upon temperature rising measured by the differential scanning calorimeter (DSC) is preferably 7° C. or below. Since the melting point of the above wax is relatively low, the wax having the broad endothermic peak, i.e., which melts at low temperature harmfully affects the storage stability of the toner.

A content of the wax in the toner is preferably 3% by mass to 10% by mass, more preferably 4% by mass to 8% by mass and still more preferably 4% by mass to 6.5% by mass. When the content is less than 3% by mass, the amount of the wax permeated between the melted toner and the fixing member in the fixing process is insufficient. Since the adhesive force between the melted toner and the fixing member is not reduced, the recording member is not separated from the fixing member. Meanwhile, when the content of the wax exceeds 10% by mass, the amount of the wax exposed on the toner surface is increased and the fluidity of the toner is deteriorated. Thus, transfer efficiency from a developing unit to the photoconductor and from the photoconductor to the recording member is reduced, not only the image quality is remarkably reduced, but also the wax is dissociated from the toner surface and contamination of the developing member and the photoconductor is sometimes caused.

A content ratio (first binder resin:second binder resin) of the first binder resin (including the amount of the internally added wax) to the second binder resin in the toner particle is preferably 20:80 to 45:55 and more preferably 30:70 to 40:60 by mass ratio. When the amount of the first binder resin is too small, the separation property and the high temperature offset resistance are sometimes reduced. When the amount of the first binder resin is too large, glossiness and heat resistant storage stability are sometimes reduced.

A softening point of the binder resin composed of the first binder resin and the second binder resin used at the above mass ratio is preferably 100° C. to 125° C. and more preferably 105° C. to 125° C. In the present invention, the softening point of the binder resin composed of the first binder resin in which the wax has been internally added and the second binder resin could be within the above range.

An acid value of the first binder resin in which the wax has been internally added is preferably 5 KOH mg/g to 50 KOH mg/g and more preferably 10 KOH mg/g to 40 KOH mg/g.

The acid value of the second binder resin is preferably 0 KOH mg/g to 10 KOH mg/g and more preferably 1 KOH mg/g to 5 KOH mg/g.

In particular, when the polyester resin is used, by using the resin having such an acid value, it is possible to enhance dispersibility of various colorants as well as to make the toner having the sufficient charge amount.

It is preferable in terms of high temperature offset resistance that the first binder resin contains the ingredient which is insoluble in tetrahydrofuran (THF). The content of the ingredient insoluble in THF in the first binder resin in which the wax has been internally added is preferably 0.1 parts by mass to 15 parts by mass, more preferably 0.2 parts by mass to 10 parts by mass and still more preferably 0.3 parts by mass and 5 parts by mass.

—Colorants—

The colorants are not particularly limited, and publicly known pigments and dyes conventionally used as the colorants for full color toners can be used. The colorants include, for example, carbon black, nigrosine dyes, iron black, naphthol yellow S, hanza yellow (10G, 5G, G), cadmium yellow, yellow iron oxide, yellow ocher, chrome yellow, titanium yellow, polyazo yellow, oil yellow, hanza yellow (GR, A, RN, R), pigment yellow L, benzidine yellow (G, GR), permanent yellow (NCG), Balkan fast yellow (5G, R), tartrazine lake, quinoline yellow lake, anthrazane yellow BGL, isoindolinone yellow, colcothar, red lead, lead vermillion, cadmium red, cadmium mercury red, antimony vermillion, permanent red 4R, parared, faicer red, parachloroorthonitroaniline red, lithol fast scarlet G, brilliant fast scarlet, brilliant carmine BS, permanent red (F2R, F4R, FRL, FRLL, F4RH), fast scarlet VD, Balkan fast rubine B, brilliant scarlet G, lithol rubine GX, permanent red F5R, brilliant carmine 6B, pigment scarlet 3B, Bordeaux 5B, toluidine maroon, permanent Bordeaux F2K, hello Bordeaux BL, Bordeaux 10B, bon maroon light, bon maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, non-metallic phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, pyridian, emerald green, pigment green B, naphthol green B, green gold, acid green lake, malachite green, phthalocyanine green, anthraquinone green, titanium oxide, zinc flower, lithopone. These may be used alone or in combination of two or more. As the colorant for the black toner, either carbon black or magnetic powder is used.

The content of the colorant in the toner is preferably in the range of 2 parts by mass to 15 parts by mass relative to 100 parts by mass of the binder resin.

It is preferable in terms of dispersibility that the colorant is used in the form of master batch where the colorant has been dispersed in the mixed binder resin of the first binder resin and the second binder resin used. The content of the master batch could be the amount so that the amount of the colorant is within the above range. It is suitable that a content percentage of the colorant in the master batch is 20% by mass to 40% by mass.

—Externally Added Agents—

In the present invention, as an externally added agent to aid the fluidity, the developing property and the charge property, other inorganic particles can be used.

The inorganic fine particles include, for example, silicon oxide, zinc oxide, tin oxide, quartz sand, titanium oxide, clay, mica, sand-lime stone, diatom earth, chromium oxide, cerium oxide, colcothar, antimony trioxide, magnesium oxide, aluminium oxide, zirconium oxide, barium sulfate, barium carbonate, calcium carbonate, silicon carbide, silicon nitride and magnesium silicate.

The total amount of the externally added agents to be added is preferably 1.0 part by mass to 5.0 parts by mass relative to 100 parts by mass of the toner base particles. When the total amount of the externally added agents to be added is larger than the above range, fog, the developing property and the fixation separation property are sometimes deteriorated. When it is smaller than the above range, the fluidity, the transfer property and the heat resistant storage stability are sometimes deteriorated.

In the method for producing the toner of the present invention, according to conventionally and publicly known methods, the first binder resin in which the hydrocarbon-based wax has been internally added, the second binder resin and the colorant are mixed, kneaded, pulverized and classified to make the toner particles (colored resin particles) having the desired particle diameter. And, the toner can be obtained by mixing the toner particles and the externally added agent.

A mass average particle diameter of the toner is preferably 4 μm to 10 μm and more preferably 5 μm to 10 μm. The ratio of the mass average particle diameter to a number average particle diameter (mass average particle diameter/number average particle diameter) is preferably 1.00 to 1.40 and more preferably 1.10 to 1.25.

The mass average particle diameter and the ratio of the mass average particle diameter to the number average particle diameter (mass average particle diameter/number average particle diameter) can be measured, for example, using a particle size measurement device "Coulter Counter TAII" supplied from Coulter Electronics.

<Developer>

The developer used in the present invention is a non-magnetic one component developer composed of each toner in the toner of the present invention or the toner kit of the present invention In the one-component developer, the toner is fed on a developer bearing member, and subsequently the development is performed by making the toner a thin layer at a layer thickness regulatory member. A time period for contact friction charge between the toner and a frictional charge member such as developer bearing member and layer thickness regulatory member is very short. Thus, in order to obtain the toner having the desired charge amount, it becomes important to control the charge of the toner. As a result, the toner is not supported on the developing roller and becomes the scattering toner to contaminate inside the image forming apparatus, or the toner is developed on the non-image region on the photoconductor, leading to the occurrence of defects such as fog. However, since the present invention aims at controlling the toner charge properly, the toner is sufficiently effective in the one-component developing method.

Since the above developer contains the toner of the present invention or each toner in the toner kit of the present invention, the occurrence of the charge-up phenomenon can be prevented, the charge reduction can be inhibited, and the good image having no defect such as scumming and image density reduction due to the charge can be obtained.

The developer can be suitably used for the image formation by the non-magnetic one-component developing method, and particularly suitably used for the following the toner container, process cartridge, image forming apparatus and image forming method.

<Toner Container>

The toner container used in the present invention is a container supplied with the toner of the present invention or the developer containing the toner of the present invention.

The toner container is not particularly limited and can be appropriately selected from conventional containers, for example, a toner container having a container main body and a cap is a suitable example.

The size, shape, structure, material and several features of the container main body is not particularly limited and can be appropriately determined depending on the intended purpose. For example, the container main body may preferably have a cylindrical shape, and most preferably a cylindrical shape in which spiral grooves are formed on its inner surface that allow toner in the container to shift to the outlet along with rotation of the main body, and in which all or part of the spiral grooves have a bellow function.

Materials for the container main body are not particularly limited and may be preferably those capable of providing accurate dimensions when fabricated and examples include resins. For example, polyester resins, polyethylene resins, polypropylene resins, polystyrene resins, polyvinyl chloride resins, polyacrylic acid resins, polycarbonate resins, ABS resins, and polyacetal resins are suitable examples.

The toner container can be readily stored and transferred, and is easy to handle. The toner container can be suitably used to supply toner by detachably attaching it to a process cartridge, image-forming apparatus or the like to be described later.

<Process Cartridge>

The process cartridge used in the present invention contains a latent electrostatic image bearing member configured to bear a latent electrostatic image, and a developing unit configured to develop the latent electrostatic image formed on the latent electrostatic image bearing member using a toner to thereby form a visible image, and further contains additional units appropriately selected.

The process cartridge is detachably attached to the image-forming apparatus and excellent in convenience.

The developing unit contains a developer storing container for storing the toner of the present invention or the developer, and a developer carrier for carrying and transferring the toner or developer stored in the developer container, and may further contains a layer-thickness control member for controlling the thickness of the layer of toner to be carried.

The process cartridge can be provided detachably in various image forming apparatuses, facsimiles and printers, and is preferably provided detachably in the image forming apparatus of the present invention described later.

Here, the process cartridge builds in, for example, a photoconductor 201, comprises the charging unit 202, the developing unit 204, the transfer unit 208 and the cleaning unit 207 as shown in FIG. 1, and further has other units as needed. In FIG. 1, 203 and 205 represent exposure by an exposing unit and a recording media, respectively.

As the photoconductor 201, the same one as in the image forming apparatus described later can be used. An optional charging member is used for the charging unit 202.

In an image formation process by the process cartridge shown in FIG. 1, the photoconductor 201 is charged by the charging unit 202 and exposed with exposure 203 by the exposing unit (not shown in the figure) with rotating in an arrow direction to form the latent electrostatic image corresponding to an exposed image on its surface. This latent electrostatic image is toner-developed in the developing unit 204, the toner-developed one is transferred to the recording media 205 by the transferring unit, and printed out. Then the surface of the photoconductor after transferring the image is cleaned by the cleaning unit 207, further the electricity is removed by the electricity removing unit (not shown in the figure), and the above operation is repeated again.

In the image forming apparatus of the present invention, the latent electrostatic image bearing member and the components such as developing unit and cleaning unit may be constituted by integrating them as the process cartridge, and this unit may be constituted detachably to the apparatus main body. Alternatively, at least one of a charging device, an exposing device, the developing unit, the transferring unit and the cleaning unit may be integrated with the latent electrostatic image bearing member to form the process cartridge, which may be made into a single unit detachable to the apparatus main body. The detachable constitution may be made using a guiding unit such as rails in the apparatus main body.

(Image-Forming Method and Image-Forming Apparatus)

The image-forming apparatus of the present invention contains an latent electrostatic image bearing member, a latent electrostatic image-forming unit, a developing unit, a transferring unit and a fixing unit, and further contains additional units such as a charge eliminating unit, a cleaning unit, a recycling unit and a controlling unit, which are optionally selected as needed.

The image-forming method of the present invention contains at least a latent electrostatic image-forming step, a developing step, a transferring step and a fixing step, and further contains additional steps such as a charge eliminating step, a cleaning step, a recycling step and a controlling step, which are optionally selected as needed.

The image forming method of the present invention can be suitably carried out by the image forming apparatus of the present invention, the latent electrostatic image forming can be performed by the latent electrostatic image forming unit, the developing can be performed by the developing unit, the transferring can be performed by the transferring unit, the fixing can be performed by the fixing unit, and the other steps can be performed by the other units.

—Latent Electrostatic Image Forming and Latent Electrostatic Image Forming Unit—

The latent electrostatic image forming is the step of forming the latent electrostatic image on the latent electrostatic image bearing member.

For the latent electrostatic image bearing member (photoconductor), its material, shape, structure and size are particularly limited, and can be optionally selected from those known publicly. Its shape suitably includes a drum shape and a belt shape. Its material includes, for example, inorganic photoconductors such as amorphous silicon and serene, and organic photoconductors such as polysilane and phthalopolymethine. Among them, amorphous silicon is preferable in terms of long lifetime.

As the amorphous silicon photoconductor, it is possible to use the photoconductor (hereinafter sometimes referred to as an "a-Si-based photoconductor") obtained by heating a support at 50° C. to 400° C. and forming a photoconductive layer composed of a-Si on the support by a film forming method, e.g., a vacuum deposition method, a sputtering method, an ion plating method, a heat CVD method, a photo CVD method and a plasma CVD method. Among them, the plasma CVD method, i.e., the method in which a raw material gas is decomposed by direct current, radio frequency wave or microwave glow discharge to form an a-Si deposition membrane on the support is suitable.

The formation of the latent electrostatic image can be performed, for example, by charging the surface of the latent electrostatic image bearing member and then exposing like the image, and can be performed by the latent electrostatic image unit.

The latent electrostatic image unit comprises at least the charging device which charges the surface of the latent electrostatic image bearing member and the exposing device which exposes the surface of the latent electrostatic image bearing member like the image.

The charge can be performed by applying the voltage onto the surface of the latent electrostatic image bearing member using the charging device.

The charging device is not particularly limited, can be optionally selected depending on the purpose, and includes, for example, conductive or semi-conductive rollers, publicly known contact charging devices comprising a brush, film and rubber blade, and non-contact charging devices such as corotron and scorotron utilizing corona discharge.

The shape of the charging member may be any shapes such as magnetic brushes and fur brushes in addition to the rollers, and can be selected depending on the specification and the form of electrophotograph apparatuses. In the case of the magnetic brush, the magnetic brush uses various ferrite particles such as Zn—Cu ferrite as the charging member, and is composed of a non-magnetic conductive sleeve for supporting this and magnetic rolls enclosed in this. When the brush id used, for example, as the material of the fur brush, the fur to which a conductive treatment has been given by carbon, copper sulfate metal or metal oxide is used, and the charging device is made by winding or sticking this to the metal or a core to which the conductive treatment has been given.

The charging device is not limited to the contact charging device as the above, but it is preferable to use the contact charging device because the image forming apparatus in which ozone generated from the charging device is reduced is obtained.

The exposure can be performed by exposing the surface of the latent electrostatic image bearing member like the image using the exposing device.

The exposing device is not particularly limited as long as it can expose the surface of the latent electrostatic image bearing member charged by the charging device like the image to be formed, can be optionally selected depending on the purpose, and includes, for example, various exposing devices, e.g., a copy optical system, a rod lens eye system, a laser optical system and a liquid crystal shutter optical system.

In the present invention, a light backside method of exposing like the image from the backside of the latent electrostatic image bearing member may be employed.

—Developing and Developing Unit—

The developing is the step of developing the latent electrostatic image using the toner or the developer of the present invention to form the visible image.

The formation of the visible image can be performed by developing the latent electrostatic image using the toner or the developer of the present invention, and can be performed by the developing unit.

The developing unit is not particularly limited as long as it can develop using the toner or the developer of the present invention, and can be optionally selected from publicly known ones. For example, those having the developing device in which the toner or the developer of the present invention is housed and which can impart the toner or the developer to the latent electrostatic image in contact or without contact are included, and the developing device comprising the toner container of the present invention is more preferable.

As the developing unit, the embodiment has the developing roller which bears the toner on the surface, rotates in cintact with the latent electrostatic image bearing member, and develops the latent electrostatic image formed on the latent electrostatic image bearing member by supplying the toner and a thin layer forming member which contacts with the surface of the developing roller and makes the toner on the developing roller a thin layer is preferable.

The developing device may use a dry developing method or a wet developing method, and may also be the developing device for a single color or the developing device for multiple colors. For example, those having a stirring device which charges the toner or the developer by frictionizing and stirring and a rotatable magnet roller are suitably included.

In the developing device, for example, the toner and the carrier are mixed and stirred, the toner is charged by friction at that time, and kept in an ear standing state on the rotating magnetic roller to form the magnetic brush. Since the magnetic roller is disposed in the vicinity of the latent electrostatic image bearing member (photoconductor), a part of the toner which composes the magnetic brush formed on the magnetic roller migrates onto the surface of the latent electrostatic image bearing member (photoconductor) by an electric suction force. As a result, the latent electrostatic image is developed by the toner and the visible image by the toner is formed on the surface of the latent electrostatic image bearing member (photoconductor).

The developer housed in the developing device is the developer containing the toner of the present invention, and the one-component developer is used as the developer.

As the developing roller, either a metal roller or an elastic roller is suitably used.

The metal roller is not particularly limited, can be optionally selected depending on the purpose, and includes, for example, an aluminium roller. The developing roller having a given surface friction coefficient can be made relatively easily by giving a blast treatment to the metal roller. Specifically, the roller surface can be roughened by giving a glass bead blast treatment to the aluminium roller, and the proper amount of the toner adhered onto the developing roller is obtained.

As the elastic roller, the roller coated with an elastic rubber layer is used, and a surface coating layer composed of the material which is easily charged to the polarity reverse to the toner polarity is further provided onto the surface. The elastic rubber layer is set to a hardness of 60 degree or less by JIS-A hardness in order to prevent the toner deterioration due to pressure concentration at an abutted section with a layer regulatory member. A surface roughness (Ra) is set to 0.3 μm to 2.0 μm, and the required amount of the toner is retained on the surface. Since development bias is applied for forming an electric field between the developing roller and the photoconductor, the elastic rubber layer is set to a resistance value of $10^3\Omega$ to $10^{10}\Omega$. The developing roller rotates clockwise, and feeds the toner retained on its surface to the position opposed to the layer regulatory member and the photoconductor.

The layer regulatory member is provided at the position lower than the abutted position of a supply roller and the developing roller. The layer regulatory member is obtained by using a metal plate spring material of stainless (SUS) or phosphorous bronze and abutting a free end side onto the surface of the developing roller by a pushing pressure of 10 N/m to 40 N/m, makes the toner passed under the pushing pressure a thin layer and imparts the charge to the toner by frictional charging. Furthermore, in order to aid the frictional charging, a regulatory bias of the value obtained by offsetting to the developing bias in the same direction as the charged polarity of the toner is imparted to the layer regulatory member.

A rubber elastic body which composes the surface of the developing roller is not particularly limited, can be optionally selected depending on the purpose, and includes, for example, a styrene-butadiene-based copolymer rubber, acrylonitrile-butadiene-based copolymer rubber, an acryl rubber, an epichlorohydrin rubber, an urethane rubber, a silicone rubber or blended ones of two or more thereof. Among them, the blended rubber of the epichlorohydrin rubber and the acrylonitrile-butadiene-based copolymer rubber is particularly preferable.

The developing roller is produced by coating an outer surface of a conductive shaft with the rubber elastic body. The conductive shaft is composed of the metal such as stainless (SUS).

Figure 2:
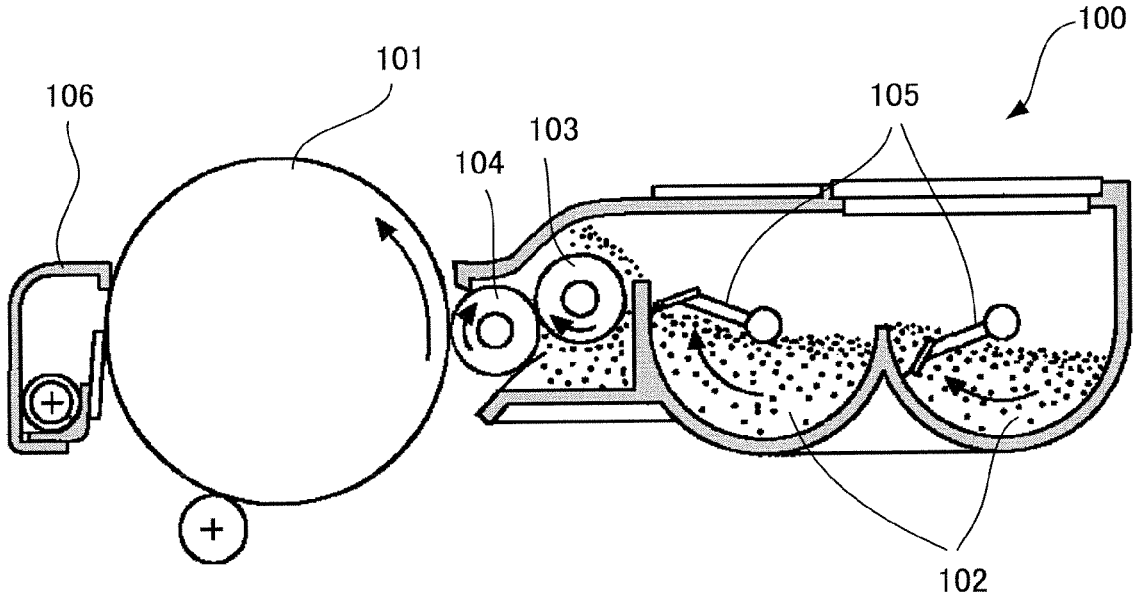
FIG. 2 is a schematic view showing one example of a developing machine used for an image forming apparatus of the present invention.

Here, FIG. 2 is a sectional view showing one example of the developing apparatus by the one-component developing method to which the present invention is applied in conjunction with the vicinity of the photoconductor 101. In this developing apparatus 100, the toner in a toner hopper 102 is supplied to the developing roller 104 by a resupply roller 103. The toner supplied on the developing roller 104 is charged by the friction of the developing roller 104 and the thin layer forming member. The toner which has not been consumed for the development is peeled from the developing roller 104 by the resupply roller 103 and returned into the toner hopper 102. An inside of the hopper is stirred by an agitator 105 to keep the toner in the uniform state. In FIG. 2, 106 represents the cleaning unit.

—Transferring and Transferring Unit—

The transferring is the step of transferring the visible image to the recording media, preferably, an intermediate transfer body is used, the visible image is primarily transferred onto the intermediate transfer body, and subsequently the visible image is secondarily transferred onto the recording media. More preferably, using two colors or more and preferably the full color toners as the toners, the first transferring in which the visible image is transferred onto the intermediate transfer body to form a complex transfer image and the second transferring in which the complex transfer image is transferred onto the recording media are comprised.

The transfer of the visible image can be performed by charging the latent electrostatic image bearing member (photoconductor) using a transfer charging device, and can be performed by the transferring unit. As the transferring unit, it is preferable to have a primary transferring unit in which the visible image is transferred onto the intermediate transfer body to form a complex transfer image and a secondary transferring unit in which the complex transfer image is transferred onto the recording media.

The intermediate transfer body is not particularly limited, can be optionally selected from publicly known transfer bodies depending on the purpose, and suitably includes, for example, a transfer belt.

The transferring unit (primary transferring unit and secondary transferring unit) preferably has at least a transferring device which peels and charges the visible image formed on the latent electrostatic image bearing member (photoconductor) to a recording media side. The transferring unit(s) may be one or two or more.

The transferring device includes a corona transferring device by corona discharge, the transfer belt, a transferring roller, a pressure transferring roller and an adhesion transferring device.

The recording media is typified by plain paper, is not particularly limited as long as an unfixed image after the development can be transferred, can be optionally selected depending on the purpose, and PET base for OHP can also be used.

—Fixing and Fixing Unit—

The fixing is the step of fixing the visible image transferred onto the recording media using a fixing apparatus, may be performed every time when transferred onto the recording media for each color of the toner or may be performed once simultaneously in the state where respective colors of the toners have been laminated.

The fixing apparatus is not particularly limited, can be optionally selected depending on the purpose, and a publicly known heating pressurizing unit is suitable. The heating pressurizing unit includes the combination of a heating roller and a pressurizing roller, and the combination of the heating roller and the pressurizing roller and an endless belt.

The heating in the heating pressurizing unit is preferably 80° C. to 200° C. usually.

In the present invention, depending on the purpose, with the fixing and the fixing unit or in place of them, for example, a publicly known photo fixing device may be used.

The electricity removing is the step of applying an electricity removing bias to the latent electrostatic image bearing member to remove the electricity, can be suitably performed by the electricity removing unit.

The electricity removing unit is not particularly limited, could apply the electricity removing bias to the latent electrostatic image bearing member, and can be optionally selected from publicly known electricity removing devices. For example, an electricity removing lamp is suitably included.

The cleaning is the step of removing the electrographic toner left on the latent electrostatic image bearing member, and can be suitably performed by the cleaning unit.

The cleaning unit is not particularly limited, could remove the toner left on the latent electrostatic image bearing member, and can be optionally selected from publicly known cleaners. For example, a magnetic brush cleaner, an electrostatic brush cleaner, a magnetic roller cleaner, a blade cleaner, a brush cleaner and a web cleaner are suitably included.

The recycling is the step of recycling the electrographic toner removed in the cleaning to the developing unit, and can be suitably performed by the recycling unit.

The recycling unit is not particularly limited, and includes publicly known feeding units.

The controlling is the step of controlling respective steps, and can be suitably performed by the controlling unit.

The controlling unit is not particularly limited as long as it can control the movement of each unit, can be optionally selected depending on the purpose, and includes, for example, equipments such as sequencers and computers.

Figure 3:
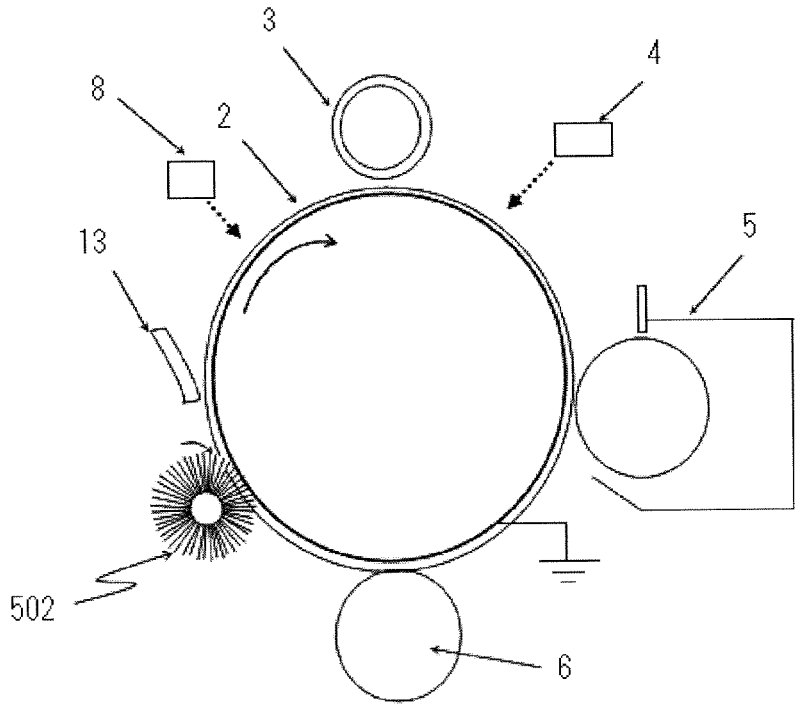
FIG. 3 is a schematic view showing one example of the image forming apparatus of the present invention.

Here, FIG. 3 is a schematic view showing one example of the image forming apparatus of the present invention. In FIG. 3, the image forming apparatus houses the photoconductor 2 driven by rotating clockwise in FIG. 3 in a housing of the image forming apparatus main body not shown in the figure, and comprises a charging section 3, a writing section 4, a developing section 5, a transferring section 7, a paper separating section, a cleaning section 13, a photoconductor electricity removing section 8, a controlling apparatus 15 and a voltage applying section 16 around the photoconductor 2.

This image forming apparatus comprises a paper supply cassette (not shown in the figure) which houses multiple record papers. The paper to be recorded in the paper supply cassette is sent out between a paper transferring section 7 and the photoconductor 2 by a paper supply roller not shown in the figure after its timing has been regulated one by one at a resist roller pair not shown in the figure.

In the image forming apparatus, the photoconductor 2 is driven by rotating clockwise in FIG. 3 to uniformly charge the photoconductor 2 at the charging section 3, subsequently the laser modulated with image data by the writing section 4 is irradiated to form the latent electrostatic image on the photoconductor 2, and the toner is adhered to the photoconductor 2 on which the latent electrostatic image has been formed to develop. In the image forming apparatus, the toner image formed on the photoconductor 2 by adhering the toner at the developing section 5 is transferred onto the record paper fed between the photoconductor 2 and the paper transferring section 7, and the record paper on which the toner image has been transferred is fed to the fixing section.

The fixing section comprises a fixing roller heated at a given fixing temperature by a built-in heater and a pressurizing roller pressed to the fixing roller with a given pressure, heats and pressurizes the record paper fed from the paper transferring section 7, fixes the toner image on the record paper, and subsequently discharges the paper to a paper discharge tray not shown in the figure.

Meanwhile, the image forming apparatus further rotates the photoconductor 2 which has transferred the toner image onto the record paper at the paper transferring section 7, removes the toner left on the photoconductor surface by scraping with a blade at the cleaning section 13 and subsequently removes the electricity at the photoconductor electricity removing section 8. The image forming apparatus uniformly charges the photoconductor 2 whose electricity has been removed at the photoconductor electricity removing section 8 at the charging section 3, and subsequently performs the subsequent image formation in the same way as the above. The cleaning section 13 is not limited to those which scrape the toner left on the photoconductor 2 with the blade, and may be, for example, those which scrape the toner left on the photoconductor 2 with a fur brush 502.

Figure 4:
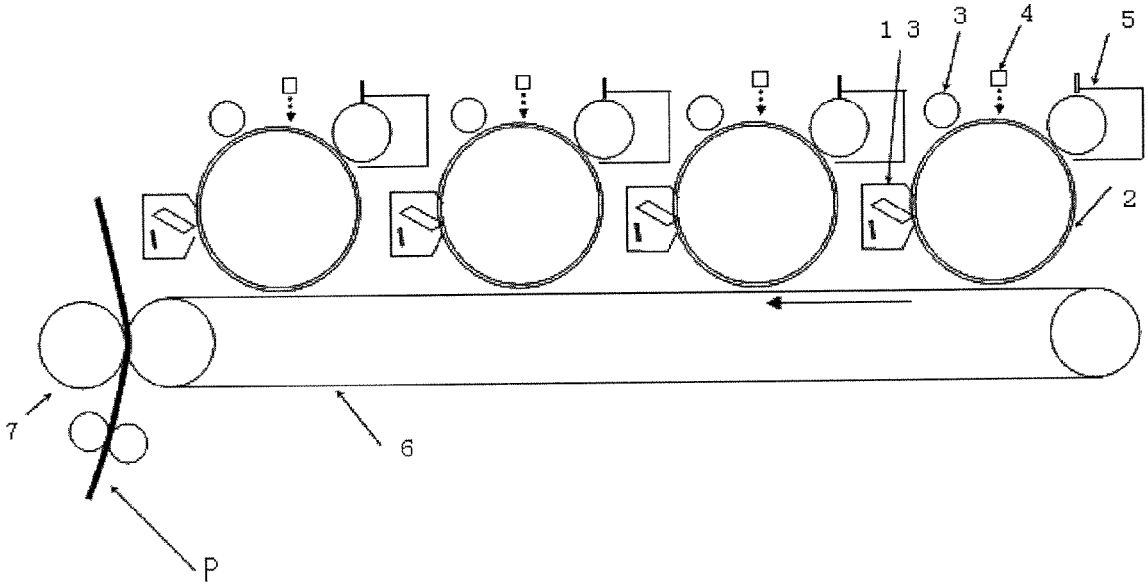
FIG. 4 is a schematic view showing one example of a tandem type full color image forming apparatus of the present invention.

FIG. 4 is a schematic view showing one example of the image forming apparatus to which the present invention has been applied. This FIG. 4 shows the tandem type full color image forming apparatus.

In this FIG. 4, in the image forming apparatus, the latent electrostatic image bearing member 2 driven by rotating clockwise in FIG. 4 is housed in the main body housing not shown in the figure, and the charging section 3, the writing section 4, the developing section 5, an intermediate transferring section 6 and the paper transferring section 7 are disposed around the latent electrostatic image bearing member 2.

The image forming apparatus comprises the paper supply cassette (not shown in the figure) which houses multiple record papers. The record paper P in the paper supply cassette is sent out between the intermediate transferring section 6 and the latent electrostatic image bearing member 2 by a paper supply roller not shown in the figure after its timing has been regulated one by one at the resist roller pair not shown in the figure.

In the image forming apparatus, the latent electrostatic image bearing member 2 is driven by rotating clockwise in FIG. 4 to uniformly charge the latent electrostatic image bearing member 2 at the charging section 3, subsequently the laser modulated with image data by the writing section 4 is irradiated to form the latent electrostatic image on the latent electrostatic image bearing member 2, and the toner is adhered to the photoconductor 2 on which the latent electrostatic image has been formed to develop. In the image forming apparatus, the toner image formed by adhering the toner at the developing section 5 is transferred onto the intermediate transfer body from the latent electrostatic image bearing member 2 at the intermediate transferring section 6. This operation is performed for each of 4 colors, cyan (C), magenta (M), yellow (Y) and black (K) to form the full color toner image.

Figure 5:
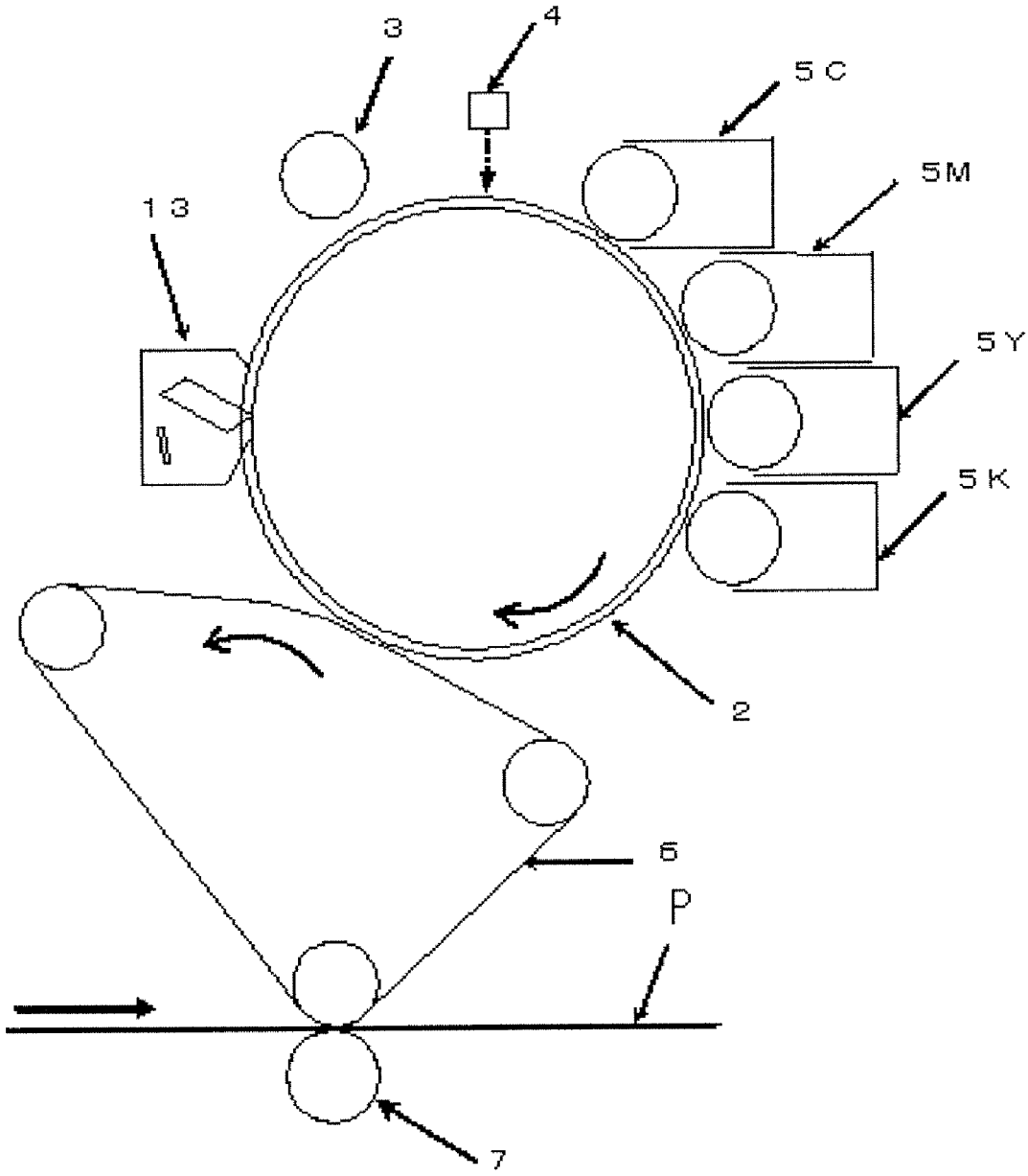
FIG. 5 is a schematic view showing one example of a revolver type full color image forming apparatus of the present invention.

Subsequently, FIG. 5 is a schematic view showing one example of a revolver type full color image forming apparatus. In this image forming apparatus, by switching the operation in the developing apparatus, the multiple color toners are sequentially developed on one latent electrostatic image bearing member. And, the color toner image on the intermediate transfer body is transferred onto the record paper P at the paper transferring section 7, and the record paper on which the toner image has been transferred is fed to the fixing section 10 to obtain the fixed image.

Meanwhile, the image forming apparatus further rotates the latent electrostatic image bearing member 2 which has transferred the toner image onto the record paper at the paper transferring section 7, removes the toner left on the latent electrostatic image bearing member surface by scraping with the blade at the cleaning section 13 and subsequently removes the electricity at the electricity removing section 8. The image forming apparatus charges the latent electrostatic image bearing member 2 whose electricity has been removed at the electricity removing section 8 at the charging section 3, and subsequently performs the subsequent image formation in the same way as the above. The cleaning section 13 is not limited to those which scrape the toner left on the latent electrostatic image bearing member 2 with the blade, and may be, for example, those which scrape the toner left on the latent electrostatic image bearing member 2 with the fur brush.

In the image forming method and the image forming apparatus of the present invention, since the developer composed of the toner of the present invention is used as the developer, the occurrence of charge-up and the charge reduction are inhibited and the good image having no defect such as scumming and image density reduction due to the charging is obtained.

Also in the image forming method and the image forming apparatus of the present invention, since the developer composed of the toner kit of the present invention is used as the developer, the color difference between under the high temperature and high humidity environment and the low temperature and low humidity environment is eliminated, there is no density unevenness on the full color image, the charge-up is inhibited, and the good image having no defect such as scumming and image density reduction due to the charging is obtained.

EXAMPLES

Examples of the present invention are described below, but the present invention is not limited to these Examples at all.

In the following Examples and Comparative Examples, a softening point, a mass average particle diameter, a particle size distribution, a melting point and a volume resistance of the toners were measured as follows.

<Measurement of Softening Point (Tm) of Toner>

Using a flow tester (CFT-500 supplied from Shimadzu Corporation), 1.5 g of a sample was weighed, using a die with a height of 1.0 mm×a diameter of 1.0 mm, the measurement was performed under a condition of a rising temperature speed at 3.0° C./minute, preheat for 180 seconds, a load of 30 kg and a measured temperature range of 80° C. to 140° C. The temperature at which a half of the above sample flowed out was rendered the softening point (Tm).

<Measurement of Mass Average Particle Diameter of Toner>

The particle size distribution of the toner particles was measured by Coulter counter method using Coulter Counter TA-II (supplied from Coulter) as follows.

First, 0.1 mL to 5 mL of a surfactant (alkyl benzene sulfonate salt) as a dispersant was added into 100 mL to 150 mL of an electrolytic aqueous solution. Here, as the electrolytic solution, Isoton-II (supplied from Coulter) obtained by preparing 1% by mass NaCl aqueous solution using first class sodium chloride can be used. Here, 2 mg to 20 mg of the sample in terms of solid content was further added. The electrolytic solution in which the sample had been suspended was treated using an ultrasonic dispersing machine for 1 to 3 minutes. Using the above measurement apparatus, the toner particles, the mass and the number of the toner particles were measured using 100 μm aperture as the aperture to calculate the mass distribution and the number distribution.

From the obtained distributions, the mass average particle diameter (Dv) and the number average particle diameter (Dp) can be calculated. As the channels, thirteen channels of 2.00 μm or more and less than 2.52 μm; 2.52 μm or more and less than 3.17 μm; 3.17 μm or more and less than 4.00 μm; 4.00 μm or more and less than 5.04 μm; 5.04 μm or more and less than 6.35 μm; 6.35 μm or more and less than 8.00 μm; 8.00 μm or more and less than 10.08 μm; 10.08 μm or more and less than 12.70 μm; 12.70 μm or more and less than 16.00 μm; 16.00 μm or more and less than 20.20 μm; 20.20 μm or more and less than 25.40 μm; 25.40 μm or more and less than 32.00 μm; and 32.00 μm or more and less than 40.30 μm were used, and the particles having the diameter of 2.00 μm or more and less than 40.30 μm were subjected.

<Measurement of Volume Resistance of Toner>

After 3 g of the toner was pressed with 5 MPa for one minute to make a pellet, the pellet was sandwiched with electrodes having a diameter of 30 mm, and the resistance was measured using an impedance analyzer type 1260 supplied from Solartron at a frequency of 1 kHz at an applied voltage of 0.1 V.

In the following Examples A-1 to A-7 and Comparative Examples A-1 to A-3, the cyan toner and the black toner are particularly described, but the magenta toner and the yellow toner can also be made and evaluated in the same way.

Example A-1

<Preparation of Cyan Toner 1>

—Synthesis of First Binder Resin H1—

First, 600 g of styrene, 110 g of butyl acrylate and 30 g of acrylic acid as vinyl-based monomers and 30 g of dicumyl peroxide as a polymerization initiator were placed in a dropping funnel.

Subsequently, in a 5 liter four-necked flask equipped with a thermometer, a stainless stirrer, a falling type condenser and a nitrogen introducing tube, 1230 g of polyoxypropylene (2.2)-2,2-bis(4-hydroxyphenyl) propane, 290 g of polyoxyethylene (2.2)-2,2-bis(4-hydroxyphenyl) propane as polyol among monomers of polyester, 250 g of isododecenyl succinic acid anhydrate, 310 g of terephthalic acid, 180 g of 1,2,4-benzene tricarboxylic acid anhydrate, 7 g of dibutyl tin oxide as an esterification catalyst and 340 g (11.0 parts by mass relative to 100 parts by mass of the monomers) of paraffin wax (melting point 73.3° C., a half value width of an endothermic peak at temperature rising measured by a differential scanning calorimeter was 4° C.) as the wax were placed.

Subsequently, under a nitrogen atmosphere in a mantle heater, with stirring at a temperature of 160° C., the mixture of the vinyl-based monomer and the polymerization initiator was dripped from the above dropping funnel over one hour. Then, with keeping at 160° C., an addition polymerization reaction was matured for 2 hours, and subsequently the temperature was raised to 230° C. and a polycondensation reaction was performed. A polymerization degree was followed by the softening point measured using a constant load extrusion capillary rheometer, and the reaction was terminated when the desired softening point was reached to yield a first binder resin H1. The softening point of the resulting first binder resin was 130° C.

—Synthesis of Second Binder Resin L1—

In a 5 liter four-necked flask equipped with a thermometer, a stainless stirrer, a falling type condenser and a nitrogen introducing tube, 2210 g of polyoxypropylene (2.2)-2,2-bis (4-hydroxyphenyl)propane as polyol, 850 g of terephthalic acid, 120 g of 1,2,4-benzene tricarboxylic acid anhydrate and 0.5 g of dibutyl tin oxide as the esterification catalyst were placed. Then, under the nitrogen atmosphere in the mantle heater, the temperature was raised to 230° C. and the polycondensation reaction was performed. The polymerization degree was followed by the softening point measured using the constant load extrusion capillary rheometer, and the reaction was terminated when the desired softening point was reached to yield a second binder resin L1. The softening point of the resulting second binder resin was 115° C.

—Preparation of Toner Particles—

To 100 parts by mass (including the mass of the internally added wax) of the binder resin composed of the first binder resin H1 and the second binder resin L1 (H1:L1=5:5), a master batch containing pigment C.I. pigment blue 15:3 corresponding to 4 parts by mass and 2 parts by mass of a benzyl boron-based compound (LR-147 supplied from Japan Carlit Co., Ltd.) as the charge controlling agent were added to make a total amount 3 kg. Then the mixture was mixed using a 20 liter Henschel mixer at a peripheral velocity of 20 m/s for 5 minutes, and subsequently melted and kneaded using a biaxial extrusion kneader (PCM-30 supplied from Ikegai Tekkosho) whose discharge section had been removed.

A resulting kneaded product was pressed and extended to a thickness of 2 mm using a cooled press roller, cooled with a cooling belt, and subsequently roughly pulverized using a feather mill. Subsequently, a pulverized product was pulverized using a mechanical pulverizer (KTM supplied from Kawasaki Heavy Industries, Ltd.) until the average particle diameter of 10 μm to 12 μm was obtained. Then, colored resin particles were obtained by pulverizing using a jet pulverizer (IDS supplied from Nippon Pneumatic MFG. Co., Ltd.) with roughly classifying and subsequently classifying fine powder using a rotor type classifying machine (deep lex type classifying machine 100ATP supplied from Hosokawa Micron Ltd.). The mass average particle diameter of the resulting colored resin particles was 7.9 μm.

To 100 parts by mass of the resulting colored resin particles, 1 part by mass of silica (RX200 supplied from Japan Aerosil Co., Ltd.) was added, and the mixture was mixed using Henschel mixer at a peripheral velocity of 40 m/s for 60 seconds to make the cyan toner 1.

Examples A-2 to A-5 and Comparative Examples A-1 and A-3

The cyan toners 2 to 8 were made in the same way as in Example A-1, except that the mixture condition of Henschel mixer, the type and the amount of the charge controlling agent were changed as shown in Table 1.

Example A-6

—Preparation of Black Toner 1—

The black toner 1 was made in the same way as in Example A-1, except that the master batch containing pigment C.I. pigment blue 15:3 corresponding to 4 parts by mass was changed to 6 parts by mass of carbon black and 1 part by mass of the benzyl boron compound (LR-147 supplied from Japan Carlit Co., Ltd.) was used as the charge controlling agent.

Example A-7

—Preparation of Black Toner 2—

The black toner 2 was made in the same way as in Example A-6, except that 1.5 parts by mass of the benzyl boron compound (LR-147 supplied from Japan Carlit Co., Ltd.) was used as the charge controlling agent.

Subsequently, for obtained each toner, the potassium ion intensity "A" on the toner surface and the potassium ion intensity "B" in the entire toner were measured as follows. Results are shown in Table 1.

<Measurement of Potassium Intensity "A" on Toner Surface>

The toner (0.5 g) was dissolved in 20 mL of ethanol. This solution (5 mL) was placed in a polyethylene container with an external diameter of 32 mm, an internal diameter of 25 mm and a height of 23 mm. Using this, an X ray intensity of potassium was measured under a condition of 50 kV, 60 mA and 40 seconds in vacuum using a bottom irradiation type fluorescent X ray measurement apparatus (Rigaku Corporation). A net intensity obtained by subtracting the background value was rendered the potassium intensity "A" present on the toner surface.

<Measurement of Potassium Intensity "B" in the Entire Toner>

The toner (0.5 g) was dissolved in 20 mL of dimethylformamide (DMF). This solution (5 mL) was placed in the polyethylene container with an external diameter of 32 mm, an internal diameter of 25 mm and a height of 23 mm. Using this, the X ray intensity of potassium was measured under the condition of 50 kV, 60 mA and 40 seconds in vacuum using the bottom irradiation type fluorescent X ray measurement apparatus (Rigaku Corporation). A net intensity obtained by subtracting the background value was rendered the potassium intensity "B" present in the entire toner.

TABLE 1

| | | Henschel mixing Condition | | | | Fluorescent X ray intensity (Kcps) | | |
|---|---|---|---|---|---|---|---|---|
| | | Peripheral | Mixing | Charge controller | | Intensity | Intensity | |
| | Toner | velocity* | hour | Type | Amount** | A*** | B**** | A/B |
| Example A-1 | Cyan 1 | 20 | 5 | LR-147 | 2 | 0.88 | 4.2 | 0.21 |
| Example A-2 | Cyan 2 | 20 | 10 | LR-147 | 2 | 0.65 | 4.3 | 0.15 |
| Example A-3 | Cyan 3 | 20 | 3 | LR-147 | 2 | 1.16 | 4.0 | 0.29 |
| Example A-4 | Cyan 4 | 20 | 5 | LR-147 | 0.3 | 0.12 | 0.6 | 0.20 |
| Example A-5 | Cyan 5 | 20 | 5 | LR-147 | 3.5 | 1.30 | 7.5 | 0.17 |
| Example A-6 | Black 1 | 20 | 5 | LR-147 | 1 | 0.39 | 2.1 | 0.19 |
| Example A-7 | Black 2 | 20 | 10 | LR-147 | 1.5 | 0.38 | 2.9 | 0.13 |
| Comparative Example A-1 | Cyan 6 | 25 | 20 | LR-147 | 2 | 0.41 | 4.5 | 0.09 |
| Comparative Example A-2 | Cyan 7 | 15 | 2 | LR-147 | 2 | 1.68 | 3.9 | 0.43 |
| Comparative Example A-3 | Cyan 8 | 20 | 5 | E-84 | 2 | Not detected | Not detected | — |

*m/s

**Parts by mass

***K intensity "A" on toner surface

****K intensity "B" in entire toner

*E-84: Salicylic acid-based Zn complex

Subsequently, using obtained each toner, various properties were evaluated as follows. The results are shown in Table 2.

<Evaluation by Actual Machine>

Using each toner, using an image forming apparatus (IP-SiO CX2500 supplied from Ricoh Co., Ltd.), a given print pattern having a printed percentage of 6% was continuously copied on 2,000 sheets of paper under N/N environment (temperature 23° C., 45% RH), and subsequently an image density and scumming were evaluated as follows.

—Scumming—

After continuously copied on 2,000 sheets, the toner on the photoconductor when the white paper was passed through was peeled onto a tape, and the tape was visually observed and evaluated by the following criteria.

[Evaluation Criteria]

A: Good
B: Normal range (no problem level for actual use)
C: Actually unusable level —Image Density—

After continuously copied on 2,000 sheets, an obtained image print was visually observed and evaluated by the following criteria.

[Evaluation Criteria]

A: Good
B: Normal range (no problem level for actual use)
C: Actually unusable level <Charge Property>

Using a suction type small charging amount measurement apparatus Model 210 HS supplied from Trek Japan Corporation, the charge amount Q was measured, and evaluated with the results determined by the following criteria.

[Determination Criteria]

TABLE 2

| | Constitution | | Scumming after 2,000 sheets | Image density after 2,000 sheets | Charging property | |
|---|---|---|---|---|---|---|
| | Roller | Regulatory blade | | | Amount (μC/g) | Judge |
| Example A-1 | Metal | Resin | A | A | −25 | A |
| Example A-2 | Resin | Metal | A | A | −28 | A |
| Example A-3 | Metal | Resin | A | A | −23 | A |
| Example A-4 | Metal | Resin | B | B | −32 | B |
| Example A-5 | Metal | Resin | B | A | −21 | A |
| Example A-6 | Metal | Resin | A | A | −25 | A |
| Example A-7 | Metal | Resin | A | A | −23 | A |
| Comparative Example A-1 | Metal | Resin | C | B | −34 | B |
| Comparative Example A-2 | Metal | Resin | C | A | −14 | C |
| Comparative Example A-3 | Metal | Resin | B | C | −38 | C |

A: −20 μC/g ≦ Q ≦ −30 μC/g
B: −30 μC/g < Q ≦ −35 μC/g, −15 μC/g ≦ Q < −20 μC/g
C: −35 μC/g < Q, Q < −15 μC/g

Production Example B-1

<Preparation of Cyan Toner 1B>

—Synthesis of First Binder Resin H1—

First, 600 g of styrene, 110 g of butyl acrylate and 30 g of acrylic acid as vinyl-based monomers and 30 g of dicumyl peroxide as a polymerization initiator were placed in a dropping funnel.

Subsequently, in a 5 liter four-necked flask equipped with a thermometer, a stainless stirrer, a falling type condenser and a nitrogen introducing tube, 1230 g of polyoxypropylene (2.2)-2,2-bis(4-hydroxyphenyl) propane, 290 g of polyoxyethylene (2.2)-2,2-bis(4-hydroxyphenyl) propane as polyol among monomers of polyester, 250 g of isododecenyl succinic acid anhydrate, 310 g of terephthalic acid, 180 g of 1,2-benzene tricarboxylic acid anhydrate, 7 g of dibutyl tin oxide as an esterification catalyst and 340 g (11.0 parts by mass relative to 100 parts by mass of the monomers) of paraffin wax (melting point 73.3° C., a half value width of an endothermic peak at temperature rising measured by a differential scanning calorimeter was 4° C.) as the wax were placed.

Subsequently, under a nitrogen atmosphere in a mantle heater, with stirring at a temperature of 160° C., the mixture of the vinyl-based monomer and the polymerization initiator was dripped from the above dropping funnel over one hour. Then, with keeping at 160° C., an addition polymerization reaction was matured for 2 hours, and subsequently the temperature was raised to 230° C. and a polycondensation reaction was performed. A polymerization degree was followed by the softening point measured using a constant load extrusion capillary rheometer, and the reaction was terminated when the desired softening point was reached to yield a first binder resin H1. The softening point of the resulting first binder resin was 130° C.

—Synthesis of Second Tin Resin L1—

In a 5 liter four-necked flask equipped with a thermometer, a stainless stirrer, a falling type condenser and a nitrogen introducing tube, 2210 g of polyoxypropylene (2.2)-2,2-bis(4-hydroxyphenyl)propane as polyol, 850 g of terephthalic acid, 120 g of 1,2,4-benzene tricarboxylic acid anhydrate and 0.5 g of dibutyl tin oxide as the esterification catalyst were placed. Then, under the nitrogen atmosphere in the mantle heater, the temperature was raised to 230° C. and the polycondensation reaction was performed. The polymerization degree was followed by the softening point measured using the constant load extrusion capillary rheometer, and the reaction was terminated when the desired softening point was reached to yield a second binder resin L1. The softening point of the resulting second binder resin was 115° C.

—Preparation of Toner Particles—

To 100 parts by mass (including the mass of the internally added wax) of the binder resin composed of the first binder resin H1 and the second binder resin L1 (H1:L1=5:5), a master batch containing pigment C.I. pigment blue 15:3 corresponding to 4 parts by mass and 2 parts by mass of a benzyl boron-based compound (LR-147 supplied from Japan Carlit Co., Ltd.) as the charge controlling agent were added to make the total amount 3 kg. Then the mixture was mixed using a 20 liter Henschel mixer at a peripheral velocity of 20 m/s for 5 minutes, and subsequently melted and kneaded using the biaxial extrusion kneader (PCM-30 supplied from Ikegai Tekkosho) whose discharge section had been removed.

A resulting kneaded product was pressed and extended to a thickness of 2 mm using a cooled press roller, cooled with the cooling belt, and subsequently roughly pulverized using the feather mill. Subsequently, a pulverized product was pulverized using the mechanical pulverizer (KTM supplied from Kawasaki Heavy Industries, Ltd.) until the average particle diameter of 10 μm to 12 μm was obtained. Then, colored resin particles were obtained by pulverizing using the jet pulverizer (IDS supplied from Nippon Pneumatic MFG. Co., Ltd.) with roughly classifying and subsequently classifying fine powder using the rotor type classifying machine (deep lex type classifying machine 100ATP supplied from Hosokawa Micron Ltd.). The mass average particle diameter of the resulting colored resin particles was 7.9 μm.

To 100 parts by mass of the resulting colored resin particles, 1 part by mass of silica (RX200 supplied from Japan Aerosil Co., Ltd.) was added, and the mixture was mixed using Henschel mixer at a peripheral velocity of 40 m/s for 60 seconds to make the cyan toner 1B. The volume resistance of the resulting cyan toner 1B was $8.4\times10^{9}\Omega$.

Production Example B-2

—Production of Magenta Toner 1B—

The magenta toner 1B was produced in the same way as in Production Example B-1, except that the master batch containing the pigment C.I. pigment blue 15:3 corresponding to 4 parts by mass was changed to the master batch containing the pigment C.I. pigment red 269 corresponding to 5 parts by mass. The volume resistance of the resulting magenta toner 1B was $9.5\times10^{9}\Omega$.

Production Example B-3

—Production of Yellow Toner 1B—

The yellow toner 1B was produced in the same way as in Production Example B-1, except that the master batch containing the pigment C.I. pigment blue 15:3 corresponding to 4 parts by mass was changed to the master batch containing the pigment C.I. pigment yellow 180 corresponding to 6 parts by mass. The volume resistance of the resulting yellow toner 1B was $9.6\times10^{9}\Omega$.

Production Example B-4

—Production of Black Toner 1B—

The black toner 1B was produced in the same way as in Production Example B-1, except that the master batch containing the pigment C.I. pigment blue 15:3 corresponding to 4 parts by mass was changed to 6 parts by mass of carbon black and 1 part by mass of the benzyl boron compound (LR-147 supplied from Japan Carlit Co., Ltd.) was used as the charge controlling agent. The volume resistance of the resulting black toner 1B was $3.7\times10^{9}\Omega$.

Production Example B-5

—Production of Black Toner 2B—

The black toner 2B was produced in the same way as in Production Example B-4, except that 2 parts by mass of the benzyl boron-based compound (LR-147 supplied from Japan Carlit Co., Ltd.) was used as the charge controlling agent and except for mixing using Henschel mixer at a peripheral velocity of 30 m/s for 20 minutes. The volume resistance of the resulting black toner 2B was $1.4\times10^{9}\Omega$.

Comparative Production Example B-1

—Production of Black Toner 3B—

The black toner 3B was produced in the same way as in Production Example B-4, except that 2 parts by mass of the benzyl boron compound (LR-147 supplied from Japan Carlit Co., Ltd.) was used as the charge controlling agent. The volume resistance of the resulting black toner 3B was $0.9\times10^{9}\Omega$.

Comparative Production Example B-2

—Production of Black Toner 4B—

The black toner 4B was produced in the same way as in Production Example B-4, except for mixing using Henschel mixer at a peripheral velocity of 15 m/s for 2 minutes. The volume resistance of the resulting black toner 4B was $0.5\times10^{9}\Omega$.

Subsequently, for obtained each toner, the potassium ion intensity on the toner surface was measured as follows. Results are shown in Table 3.

<Measurement of Potassium Intensity on Toner Surface>

The toner (0.5 g) was dissolved in 20 mL of ethanol. This solution (5 mL) was placed in the polyethylene container with an external diameter of 32 mm, an internal diameter of 25 mm and a height of 23 mm. Using this, the X ray intensity of potassium was measured under the condition of 50 kV, 60 mA and 40 seconds in vacuum using the bottom irradiation type fluorescent X ray measurement apparatus (Rigaku Corporation). A net intensity obtained by subtracting the background value was rendered the potassium intensity present on the toner surface.

TABLE 3

| | | Henschel mixing condition | | | | Fluorescent X-ray intensity |
|---|---|---|---|---|---|---|
| | | Peripheral | Mixing | Charge controller | | Potassium intensity |
| | Toner | velocity | time | Type | Amount | on toner surface |
| Production Example B-1 | Cyan toner 1B | 20 | 5 | LR-147 | 2 | 0.88 |

TABLE 3-continued

| | | Henschel mixing condition | | | | Fluorescent X-ray intensity |
|---|---|---|---|---|---|---|
| | | Peripheral | Mixing | Charge controller | | Potassium intensity |
| | Toner | velocity | time | Type | Amount | on toner surface |
| Production Example B-2 | Magenta toner 1B | 20 | 5 | LR-147 | 2 | 0.82 |
| Production Example B-3 | Yellow toner 1B | 20 | 5 | LR-147 | 2 | 0.90 |
| Production Example B-4 | Black toner 1B | 20 | 5 | LR-147 | 1 | 0.45 |
| Production Example B-5 | Black toner 2B | 30 | 20 | LR-147 | 2 | 0.51 |
| Comparative Production Example B-1 | Black toner 3B | 20 | 5 | LR-147 | 2 | 0.95 |
| Comparative Production Example B-2 | Black toner 4B | 15 | 2 | LR-147 | 1 | 092 |

Peripheral; velocity (m/s)
Mixing time (minutes)
Amount (parts by mass)

Examples B-1 to B-2 and Comparative Examples B-1 to B-2

Subsequently, respective toner kits of Examples B-1 to B-2 and Comparative Examples B-1 to B-2 were prepared by combining the obtained toners as shown in the following Table 4.

TABLE 4

| | Toner kit | Toner | | | |
|---|---|---|---|---|---|
| Example B-1 | Toner kit 1 | Black toner 1B 0.45 | Cyan toner 0.88 | Yellow toner 0.90 | Magenta toner 0.82 |
| Example B-2 | Toner kit 2 | Black toner 2B 0.51 | Cyan toner 0.88 | Yellow toner 0.90 | Magenta toner 0.82 |
| Comparative Example B-1 | Toner kit 3 | Black toner 3B 0.95 | Cyan toner 0.88 | Yellow toner 0.90 | Magenta toner 0.82 |
| Comparative Example B-2 | Toner kit 4 | Black toner 4B 0.92 | Cyan toner 0.88 | Yellow toner 0.90 | Magenta toner 0.82 |

All color toners other than black toners are 1B.

A lower column for each toner represents the potassium ion intensity on the toner surface.

Subsequently, using obtained each toner and the toner kit, various properties were evaluated as follows. The results are shown in Tables 5 to 8.

<Evaluation by Actual Machine>

Using each toner and toner kit, using an image forming apparatus (IPSiO CX2500 supplied from Ricoh Co., Ltd.) and changing the constitution of the developing apparatus as shown in Table 5, the adhered amount on the photoconductor in the same development bias (minus 200 V) was measured under the N/N environment (temperature 22° C. and 55% RH), the L/L environment (temperature 10° C. and 20% RH) and the H/H environment (temperature 28° C. and 80% RH), and evaluated by the following criteria. The adhered amount was measured using the suction type small charging amount measurement apparatus Model 210 HS supplied from Trek Japan Corporation.

[Evaluation Criteria]

A: The difference between the toners in the toner kit is within ±5% and is good.

B: The difference between the toners in the toner kit is within ±10% and is practically no problem.

C: The difference between the toners in the toner kit is more than ±10% and is the unusable level.

<Image Quality (Image Unevenness)>

Figure 6:
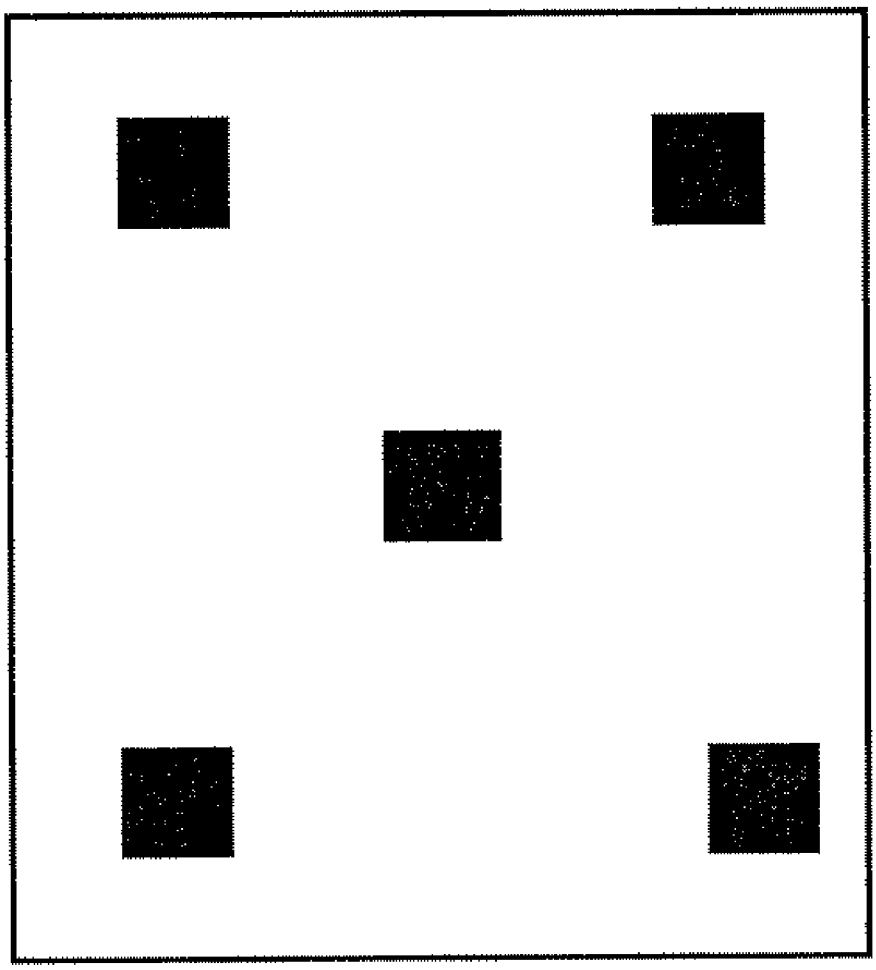
FIG. 6 is a view showing a printing pattern used for evaluating image quality (image unevenness) in Examples.

A printing pattern of five solid images of 1 cm×1 cm shown is in FIG. 6 was printed on one A4 size sheet, a density difference (ΔOD) of each toner and toner kit in five solid images was measured and evaluated by the following criteria.

[Evaluation Criteria]

A: ΔOD≦0.1
B: 0.1<ΔOD≦0.2
C: 0.2<ΔOD

<Scumming>

A blank image was printed on 1,000 sheets using each toner and toner kit, the amount T of the recovered toner was measured and evaluated by the following criteria.

[Evaluation Criteria]

A: T≦3 g
B: 3 g<T≦5 g
C: 5 g<T

<Charge Property>

The charge amount Q was measured using the suction type small charging amount measurement apparatus Model 210

HS supplied from Trek Japan Corporation and evaluated by the following criteria.

[Evaluation Criteria]

[Determination of Charge Amount of Each Toner]

A: −20 μC/g≦Q≦−30 μC/g

B: −30 μC/g<Q≦−35 μC/g, −15 μC/g≦Q<−20 μC/g

C: −35 μC/g<Q<−15 μC/g

[Determination of Charge Amount Difference ΔQ in Toner Kit]

A: ΔQ≦5 μC/g

B: 5 μC/g<ΔQ≦8 μC/g

C: 8 μC/g<ΔQ

TABLE 5

| | | Constitution | | N/N environment (22° C., 55% RH) | | | |
|---|---|---|---|---|---|---|---|
| | Toner | Roller | Regulatory blade | Adhered amount* | Charging amount** | Scumming amount*** | Density difference |
| Production Example B-1 | Cyan toner 1B | Metal | Resin | 8.1 | −23 | 2.5 | 0.05 |
| Production Example B-2 | Magenta 1B | Metal | Resin | 8.0 | −24 | 2.6 | 0.05 |
| Production Example B-3 | Yellow toner 1B | Metal | Resin | 8.3 | −25 | 2.3 | 0.04 |
| Production Example B-4 | Black toner 1B | Metal | Resin | 8.2 | −24 | 2.5 | 0.06 |
| Production Example B-5 | Black toner 2B | Resin | Metal | 8.5 | −23 | 2.6 | 0.08 |
| Comparative Production Example B-1 | Black toner 3B | Metal | Resin | 9.8 | −15 | 3.8 | 0.12 |
| Comparative Production Example B-2 | Black toner 4B | Metal | Resin | 9.2 | −16 | 3.5 | 0.13 |

*Initial adhered amount on photoconductor (g/m$^2$)

**Initial charging amount (μC/g)

***Scumming amount (g)

****Image density difference (ΔOD)

TABLE 6

| | L/L environment (10° C., 20% RH) | | | | H/H environment (28° C., 80% RH) | | | |
|---|---|---|---|---|---|---|---|---|
| | Adhered amount* | Charging amount** | Scumm. amount[1)] | Image density[2)] | Adhered amount* | Charging amount** | Scumm. amount | Image density[2)] |
| Production Example B-1 | 6.8 | −27 | 2.0 | 0.04 | 9.2 | −20 | 2.8 | 0.07 |
| Production Example B-2 | 7.0 | −27 | 2.1 | 0.04 | 9.1 | −21 | 2.9 | 0.08 |
| Production Example B-3 | 7.0 | −29 | 1.8 | 0.03 | 9.3 | −22 | 2.5 | 0.05 |
| Production Example B-4 | 7.2 | −26 | 2.2 | 0.04 | 9.4 | −21 | 2.8 | 0.06 |
| Production Example B-5 | 7.2 | −27 | 2.4 | 0.06 | 9.6 | −20 | 2.8 | 0.09 |
| Comparative Production Example B-1 | 7.6 | −20 | 3.0 | 0.09 | 10.5 | −13 | 6.1 | 0.21 |
| Comparative Production Example B-2 | 6.1 | −21 | 2.6 | 0.1 | 9.8 | −13 | 5.5 | 0.2 |

*Initial adhered amount on photoconductor (g/m$^2$)

**Initial charging amount (μC/g)

[1)]Scumming amount (g)

[2)]Image density difference (ΔOD)

TABLE 7

| | | N/N environment | | L/L environment | | Hill environment | |
|---|---|---|---|---|---|---|---|
| | Toner kit | Adhered | Charging | Adhered | Charging | Adhered | Charging |
| Example B1 | Toner kit 1 | 1.8 | −2 | 2.9 | −3 | 1.6 | −2 |
| Example B-2 | Toner kit 2 | 3.3 | −2 | 2.9 | −2 | 3.2 | −2 |
| Comparative Example B-1 | Toner kit 3 | 14.6 | −10 | 7 | −9 | 10.2 | −9 |

TABLE 7-continued

| | Toner kit | N/N environment | | L/L environment | | Hill environment | |
|---|---|---|---|---|---|---|---|
| | | Adhered | Charging | Adhered | Charging | Adhered | Charging |
| Comparative Example B-2 | Toner kit 4 | 9.5 | −9 | 9.3 | −8 | 9.4 | −9 |

Adhered: difference of adhered amounts between toners (%)
Charging: difference of charging amount between toners (ΔQ)
N/N environment: 22° C., 55% RH
L/L environment: 10° C., 20% RH
H/H environment: 28° C., 80% RH

TABLE 8

| | Adhered amount difference | | | Charging property | | | Image quality (density | | | Scumming | | |
|---|---|---|---|---|---|---|---|---|---|---|---|---|
| | N/N | L/L | H/H | N/N | L/L | H/H | N/N | L/L | H/H | N/N | L/L | H/H |
| Production Example B-1 | — | — | — | A | A | A | A | A | A | A | A | A |
| Production Example B-2 | — | — | — | A | A | A | A | A | A | A | A | A |
| Production Example B-3 | — | — | — | A | A | A | A | A | A | A | A | A |
| Production Example B-4 | — | — | — | A | A | A | A | A | A | A | A | A |
| Production Example B-5 | — | — | — | A | A | A | A | A | A | A | A | A |
| Comparative Production Example B-1 | — | — | — | B | A | C | B | A | C | B | A | C |
| Comparative Production Example B-2 | — | — | — | B | A | C | B | B | C | B | A | C |
| Example B-1 | A | A | A | A | A | A | — | — | — | — | — | — |
| Example B-2 | A | A | A | A | A | A | — | — | — | — | — | — |
| Comparative Example B-1 | C | B | C | C | C | C | — | — | — | — | — | — |
| Comparative Example B-2 | B | B | A | C | B | C | — | — | — | — | — | — |

*N/N represent 22° C. and 55% RH environment.
*L/L represent 10° C. and 20% RH environment.
*N/N represent 28° C. and 80% RH environment.

The method for producing the toner and the toner of the present invention are widely used for the developer, the process cartridge, the image forming method and the image forming apparatus because the occurrence of the charge-up and the charge reduction are inhibited and the good image having no defect such as scumming and image density reduction due to the charge can be formed by controlling the amount of the charge controlling agent present in the toner inside and on the toner surface.

The toner kit of the present invention is widely used for the developer, the process cartridge, the image forming method and the image forming apparatus of full color because the color difference between under the high temperature and high humidity environment and the low temperature and low humidity environment is eliminated, no density unevenness is observed on the full color image, the charge-up is inhibited and the good image having no defect such as scumming and density reduction due to the charge can be formed by controlling the amount of the charge controlling agent present on the surface of the black toner and color toners.

What is claimed is:

1. A toner comprising:

a binder resin, a colorant, and a charge controlling agent, wherein the charge controlling agent comprises a molecular structure containing $K^+$ as a counterion, and a ratio (A/B) of a $K^+$ intensity "A" detected by fluorescent X ray on a surface of the toner to a $K^+$ intensity "B" detected by fluorescent X ray in the entire toner is 0.1 to 0.3.

2. The toner according to claim 1, wherein the charge controlling agent is a benzyl boron compound represented by a structural formula:

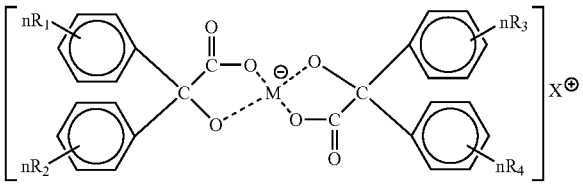

wherein in the structural formula, M is B (boron), X is K (potassium), $R_1$, $R_2$, $R_3$ or $R_4$ represent each hydrogen atoms, alkyl groups having 1 to 4 carbon atoms, alkoxy groups having 1 to 4 carbon atoms or halogen atoms, when multiple $R_1$, $R_2$, $R_3$ or $R_4$ are present, they may be the same or different, and n is an integer of 1 to 5.

3. The toner according to claim 2, wherein the charge controlling agent is a benzyl boron compound represented by a structural formula:

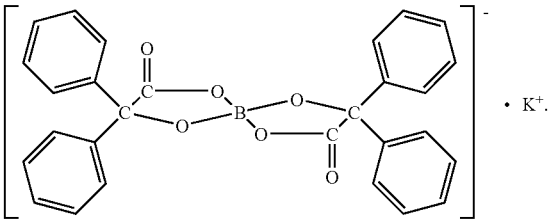

4. The toner according to claim 1, wherein a content of the charge controlling agent is 0.5 parts by mass to 3 parts by mass relative to 100 parts by mass of the binder resin.

5. A method for producing toner comprising:

mixing a toner material containing at least a binder resin, a colorant and a charge controlling agent having a molecular structure containing $K^+$ as a counterion so that a ratio (A/B) of $K^+$ intensity "A" detected by fluorescent X ray on the toner surface to $K^+$ intensity "B" detected by fluorescent X ray in the entire toner is 0.1 to 0.3, and kneading and pulverizing a resulting kneaded product.

6. The method for producing toner according to claim 5, wherein the charge controlling agent is a benzyl boron compound represented by a structural formula:

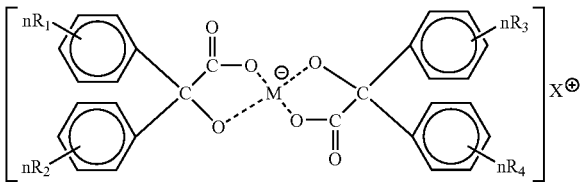

wherein in the structural formula, M is B (boron), X is K (potassium), $R_1$, $R_2$, $R_3$ or $R_4$ represent each hydrogen atoms, alkyl groups having 1 to 4 carbon atoms, alkoxy groups having 1 to 4 carbon atoms or halogen atoms, when multiple $R_1$, $R_2$, $R_3$ or $R_4$ are present, they may be the same or different, and n is an integer of 1 to 5.

7. The method for producing toner according to claim 6, wherein the charge controlling agent is a benzyl boron compound represented by a structural formula:

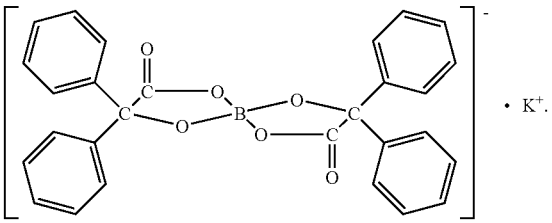

8. A toner kit comprising:

a black toner, a yellow toner, a magenta toner, and a cyan toner, wherein all of the black toner, the yellow toner, the magenta toner and the cyan toner comprise a binder resin, a colorant and a charge controlling agent, and the colorant of the black toner comprises at least one of carbon black and magnetic powder, wherein the charge controlling agent comprises a molecular structure containing $K^+$ as a counterion, wherein when a $K^+$ intensity detected by the fluorescent X ray on the surface of the black toner is Kk, a $K^+$ intensity detected by the fluorescent X ray on the surface of the yellow toner is Ky, a $K^+$ intensity detected by the fluorescent X ray on the surface of the magenta toner is Km and a $K^+$ intensity detected by the fluorescent X ray on the surface of the cyan toner is Kc, the formulae: Kk<Ky, Kk<Km and Kk<Kc are fulfilled.

9. The toner kit according to claim 8, wherein each toner in the toner kit comprises, at least the binder resin, the colorant and the charge controlling agent, wherein the charge controlling agent comprises the molecular structure containing K+ as the counterion, and a ratio (A/B) of a K+ intensity "A" detected by fluorescent X ray on a surface of the toner to a K+ intensity "B" detected by fluorescent X ray in the entire toner is 0.1 to 0.3.

10. The toner kit according to claim 8, wherein the ratio of Kk to Ky (Kk/Ky), the ratio of Kk to km (Kk/Km) and the ratio of Kk to Kc (Kk/Kc) are 0.3 to 0.6.

11. The toner kit according to claim 8, wherein when a volume resistance of the black toner is Rk, a volume resistance of the yellow toner is Ry, a volume resistance of the magenta toner is Rm, and a volume resistance of the cyan toner is Rc, the formulae: Rk<Ry, Rk<Rm and Rk<Rc are fulfilled.

12. The toner kit according to claim 8, wherein a volume resistance Rk of the black toner is $0.9\times10^9\Omega$ to $5\times10^9\Omega$.

13. The toner kit according to claim 8, wherein the charge controlling agent is a benzyl boron compound represented by a structural formula:

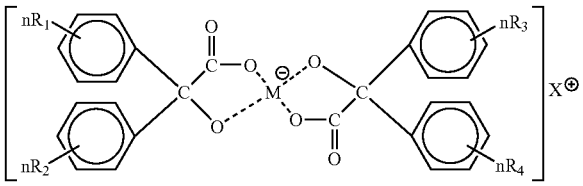

wherein in the structural formula, M is B (boron), X is K (potassium), $R_1$, $R_2$, $R_3$ or $R_4$ represent each hydrogen atoms, alkyl groups having 1 to 4 carbon atoms, alkoxy groups having 1 to 4 carbon atoms or halogen atoms, when multiple $R_1$, $R_2$, $R_3$ or $R_4$ are present, they may be the same or different, and n is an integer of 1 to 5.

14. The toner kit according to claim 13, wherein the charge controlling agent is a benzyl boron compound represented by a structural formula:

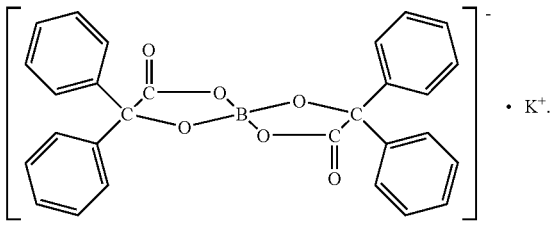

15. The toner kit according to claim 8, wherein a content of the charge controlling agent in each toner is 0.5 parts by mass to 3 parts by mass relative to 100 parts by mass of the binder resin.

16. The toner kit according to claim 8, wherein each toner in the toner kit is produced by mixing a toner material comprising at least the binder resin, the colorant and the charge controlling agent wherein the charge controlling agent comprises the molecular structure containing $K^+$ as the counterion so that a ratio (A/B) of a $K^+$ intensity "A" detected by fluorescent X ray on a surface of the toner to a $K^+$ intensity "B" detected by fluorescent X ray in the entire toner is 0.1 to 0.3, and kneading and pulverizing a resulting kneaded product.

17. An image-forming apparatus comprising:

a latent electrostatic image bearing member, a latent electrostatic image forming unit configured to form a latent electrostatic image on the latent electrostatic image bearing member, a developing unit configured to develop the latent electrostatic image using each toner in a toner kit to form a visible image, a transfer unit configured to transfer the visible image to a recording medium, and a fixing unit configured to fix the transferred image on the recording medium, wherein the toner kit comprises, at least a black toner, a yellow toner, a magenta toner, and a cyan toner, wherein all of the black toner, the yellow toner, the magenta toner and the cyan toner comprise a binder resin, a colorant and a charge controlling agent, and the colorant of the black toner comprises at least one of carbon black and magnetic powder, wherein the charge controlling agent comprises a molecular structure containing $K^+$ as a counterion, wherein when a $K^+$ intensity detected by the fluorescent X ray on the surface of the black toner is Kk, a $K^+$ intensity detected by the fluorescent X ray on the surface of the yellow toner is Ky, a $K^+$ intensity detected by the fluorescent X ray on the surface of the magenta toner is Km and a $K^+$ intensity detected by the fluorescent X ray on the surface of the cyan toner is Kc, the formulae: $Kk<Ky$, $Kk<Km$ and $Kk<Kc$ are fulfilled.

18. The image forming apparatus according to claim 17, wherein the developing unit comprises a developing roller which bears the toner on its surface, rotates in contact with the latent electrostatic image bearing member and develops the latent electrostatic image formed on the latent electrostatic image bearing member by supplying the toner, and a thin layer forming member which contacts with the surface of the developing roller and makes the toner on the developing roller a thin layer.

19. An image forming method comprising:

forming a latent electrostatic image on a latent electrostatic image bearing member, developing the latent electrostatic image using each toner in a toner kit to form a visible image, transferring the visible image onto a recording medium, and fixing the transferred visible image on the recording medium, wherein the toner kit comprises, at least a black toner, a yellow toner, a magenta toner, and a cyan toner, wherein all of the black toner, the yellow toner, the magenta toner and the cyan toner comprise a binder resin, a colorant and a charge controlling agent, and the colorant of the black toner comprises at least one of carbon black and magnetic powder, wherein the charge controlling agent comprises a molecular structure containing $K^+$ as a counterion, wherein when a $K^+$ intensity detected by the fluorescent X ray on the surface of the black toner is Kk, a $K^+$ intensity detected by the fluorescent X ray on the surface of the yellow toner is Ky, a $K^+$ intensity detected by the fluorescent X ray on the surface of the magenta toner is Km and a $K^+$ intensity detected by the fluorescent X ray on the surface of the cyan toner is Kc, the formulae: $Kk<Ky$, $Kk<Km$ and $Kk<Kc$ are fulfilled.

* * * * *